US009257048B1

(12) United States Patent
Offer et al.

(10) Patent No.: US 9,257,048 B1
(45) Date of Patent: Feb. 9, 2016

(54) AIRCRAFT EMERGENCY LANDING ROUTE SYSTEM

(71) Applicant: The Boeing Company, Chicago, IL (US)

(72) Inventors: Brad W. Offer, Burien, WA (US); Paul Clark Parks, Mercer Island, WA (US); Alan Eugene Bruce, Kent, WA (US); Charles B. Spinelli, Bainbridge Island, WA (US); Travis S. Reid, Seattle, WA (US)

(73) Assignee: THE BOEING COMPANY, Chicago, IL (US)

( * ) Notice: Subject to any disclaimer, the term of this patent is extended or adjusted under 35 U.S.C. 154(b) by 305 days.

(21) Appl. No.: 13/746,076

(22) Filed: Jan. 21, 2013

Related U.S. Application Data

(63) Continuation-in-part of application No. 12/764,797, filed on Apr. 21, 2010.

(51) Int. Cl.
*G08G 5/02* (2006.01)
*G08G 5/00* (2006.01)

(52) U.S. Cl.
CPC ..... *G08G 5/0039* (2013.01); *G08G 5/02* (2013.01)

(58) Field of Classification Search
None
See application file for complete search history.

(56) References Cited

U.S. PATENT DOCUMENTS

| | | | | |
|---|---|---|---|---|
| 4,086,632 | A | 4/1978 | Lions | |
| 5,057,835 | A | 10/1991 | Factor et al. | |
| 5,398,186 | A | 3/1995 | Nakhla | |
| 5,842,142 | A | 11/1998 | Murray et al. | |
| 6,519,527 | B2 | 2/2003 | Shinagawa | |
| 6,573,841 | B2 | 6/2003 | Price | |
| 6,643,580 | B1 | 11/2003 | Naimer et al. | |
| 6,804,585 | B2 | 10/2004 | Humbard et al. | |
| 6,963,291 | B2 | 11/2005 | Holforty et al. | |
| 7,689,328 | B2 | 3/2010 | Spinelli | |
| 7,693,614 | B2 | 4/2010 | Turung | |
| 7,874,521 | B2 | 1/2011 | Shuster | |
| 8,285,427 | B2 * | 10/2012 | Rogers et al. | 701/3 |
| 8,977,484 | B1 | 3/2015 | La Civita | |
| 9,020,662 | B2 | 4/2015 | Felix et al. | |
| 2002/0140578 | A1 | 10/2002 | Price | |
| 2003/0060940 | A1 | 3/2003 | Humbard et al. | |

(Continued)

FOREIGN PATENT DOCUMENTS

| | | | |
|---|---|---|---|
| EP | 1796060 | A1 | 6/2007 |
| EP | 2040137 | A1 | 3/2009 |

(Continued)

OTHER PUBLICATIONS

PCT search report dated Nov. 21, 2011 regarding application PCT/US2011/028795, filed Mar. 17, 2011, applicant The Boeing Company, 10 pages.

(Continued)

*Primary Examiner* — John Q Nguyen
*Assistant Examiner* — Edward Torchinsky
(74) *Attorney, Agent, or Firm* — Yee & Associates, P.C.

(57) ABSTRACT

A method and apparatus for managing a landing site for an aircraft is presented. The landing site is selected from a group of landing sites. A description is communicated to a platform about a state of the aircraft along a route of the aircraft over time to the landing site. The aircraft is flown to the landing site using the description of the state of the aircraft along the route of the aircraft over time.

20 Claims, 18 Drawing Sheets

(56) References Cited

U.S. PATENT DOCUMENTS

| | | | | |
|---|---|---|---|---|
| 2005/0216138 | A1* | 9/2005 | Turung | 701/3 |
| 2007/0138345 | A1* | 6/2007 | Shuster | 244/186 |
| 2008/0154447 | A1* | 6/2008 | Spinelli | 701/7 |
| 2008/0221745 | A1 | 9/2008 | Diamandis et al. | |
| 2010/0161156 | A1 | 6/2010 | Coulmeau et al. | |
| 2010/0161160 | A1* | 6/2010 | Wilson et al. | 701/15 |
| 2010/0305781 | A1 | 12/2010 | Felix | |
| 2011/0264312 | A1* | 10/2011 | Spinelli et al. | G08G 5/0021 701/16 |

FOREIGN PATENT DOCUMENTS

| | | | |
|---|---|---|---|
| WO | WO2009042405 | A2 | 4/2009 |
| WO | WO2011152917 | A2 | 12/2011 |

OTHER PUBLICATIONS

Non-final office action dated Jun. 22, 2012 regarding U.S. Appl. No. 12/764,797, 16 pages.
Non-final office action dated Sep. 10, 2012 regarding U.S. Appl. No. 12/679,275, 13 pages.
European search report for application No. EP07380259 dated May 26, 2008, 1 page.
Gallo et al., "Advanced Aircraft Performance Modeling for ATM: BADA 4.0 Results," 25th Digital Avionics Systems Conference, Oct. 2006, IEEE, 12 pages.
International search report dated Sep. 15, 2010 regarding application PCT/US2008/075877, 2 pages.
Vilaplana et al., "Towards a Formal Language for the Common Description on Aircraft Intent," 24th Digital Avionics Systems Conference, Oct. 2005, IEEE, 9 pages.
Extended European Search Report, dated Feb. 4, 2013, regarding Application No. EP12382273.6, 8 pages.
Krozel, "Intent Inference for Free Flight Aircraft", AIAA Guidance, Navigation, and Control Conference and Exhibit, AIAA-00/4479, Aug. 2000, 11 pages.
Krozel et al., "Intent Inference with Path Prediction", Journal of Guidance, Control, and Dynamics, vol. 29, No. 2, Mar.-Apr. 2006, pp. 225-236.
López Leonés, "Definition of an Aircraft Intent Description Language for Air Traffic Management Applications", Doctor of Philosophy Thesis, University of Glasgow, Feb. 2008, 404 pages.
López Leonés, "REACT Project: Preliminary Set of Requirements for an AIDL", REACT Workshop, Jun. 2008, 29 pages.
Lovera Yepes et al, "New Algorithms for Aircraft Intent Inference and Trajectory Prediction", Journal of Guidance, Control, and Dynamics, vol. 30, No. 2, Mar.-Apr. 2007, pp. 370-382.
Vilaplana, "Intent Synchronization", Eurocontrol/FAA Workshop on Avionics for 2011 and Beyond, Oct. 2005, 19 pages.
Final Office Action, dated Apr. 8, 2013, regarding USPTO U.S. Appl. No. 12/679,275, 21 pages.
Final Office Action, dated Feb. 13, 2013, regarding USPTO U.S. Appl. No. 12/764,797, 13 pages.
Office Action dated Jun. 4, 2015, regarding USPTO U.S. Appl. No. 14/604,723, 32 pages.
Final Office Action, dated Mar. 26, 2014, regarding USPTO U.S. Appl. No. 12/679,275, 21 pages.
Notice of Allowance, dated Dec. 24, regarding USPTO U.S. Appl. No. 12/679,275, 19 pages.
Office Action dated Sep. 26, 2014, regarding USPTO U.S. Appl. No. 13/972,911, 18 pages.
Notice of Allowance dated Oct. 29, 2014, regarding USPTO U.S. Appl. No. 13/972,911, 8 pages.

* cited by examiner

AIRCRAFT EMERGENCY LANDING ROUTE SYSTEM

CROSS-REFERENCE TO RELATED APPLICATION

This application is a continuation-in-part of patent application U.S. Ser. No. 12/764,797, filed Apr. 21, 2010, Publication No. 2011/0264312, entitled "Determining Landing Sites for Aircraft," which is incorporated herein by reference. This application is also related to the following patent application entitled "Predicting Aircraft Trajectory," U.S. Ser. No. 12/679,275, filed Aug. 4, 2010, U.S. Publication No. 2010/0305781, assigned to the same assignee, and incorporated herein by reference.

BACKGROUND INFORMATION

1. Field

The present disclosure relates generally to aircraft and, in particular, to landing sites for aircraft. Still more particularly, the present disclosure relates to a method and apparatus for describing a route to a landing site using a formal language.

2. Background

Commercial aircraft have planned routes from an originating airport to a destination airport. However, during the flight of an aircraft, events may result in the use of a different landing site other than the destination airport. This alternative landing site may be, for example, an alternate airport. Events such as thunderstorms, inconsistencies in the aircraft, changes in usable airspace, issues at the destination airport, and other events may result in an alternate landing site being selected for the aircraft.

Although a pilot of an aircraft is highly trained in emergency procedures, the pilot may be focused on tasks other than selecting an alternate landing site. For example, the pilot may be focused on managing flight of the aircraft in heavy turbulence, flying the aircraft with an undesired configuration, or on some other task. These and other situations may be stressful and may require more attention from the pilot than desired.

The pilot may assess the available landing site options that are in range of the aircraft and select one of these landing sites from the pilot's prior experience. The pilot may then find a way to fly the aircraft to the selected landing site avoiding terrain, no-fly zones, other aircraft, and other obstacles that may be present in reaching the selected landing site.

Currently, this burden of assessing landing sites and routes to landing sites is placed on the pilot with some potential help from an air traffic controller. The air traffic controller may provide assistance through the knowledge of the overall state of the airspace around the aircraft. Additionally, other aides may be present, such as navigation systems, which may select the nearest airport to the current location of the aircraft.

These types of systems, however, do not take into account potential intervening terrain, no-fly zones, weather conditions, and other obstacles. The navigation systems may only provide a simple direct point-to-point route for the aircraft.

Therefore, it would be desirable to have a method and apparatus that takes into account at least some of the issues discussed above, as well as other possible issues.

SUMMARY

In one illustrative embodiment, a method for managing a landing site for an aircraft is presented. The landing site is selected from a group of landing sites. A description is communicated to a platform of a state of the aircraft along a route of the aircraft over time to the landing site. The aircraft is flown to the landing site using the description of the state of the aircraft along the route of the aircraft over time.

In another illustrative embodiment, an apparatus comprises a navigation tool. The navigation tool is configured to select a landing site from a group of landing sites and communicate to a platform a description of a state of the aircraft along a route of the aircraft over time to the landing site.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

Figure 1:
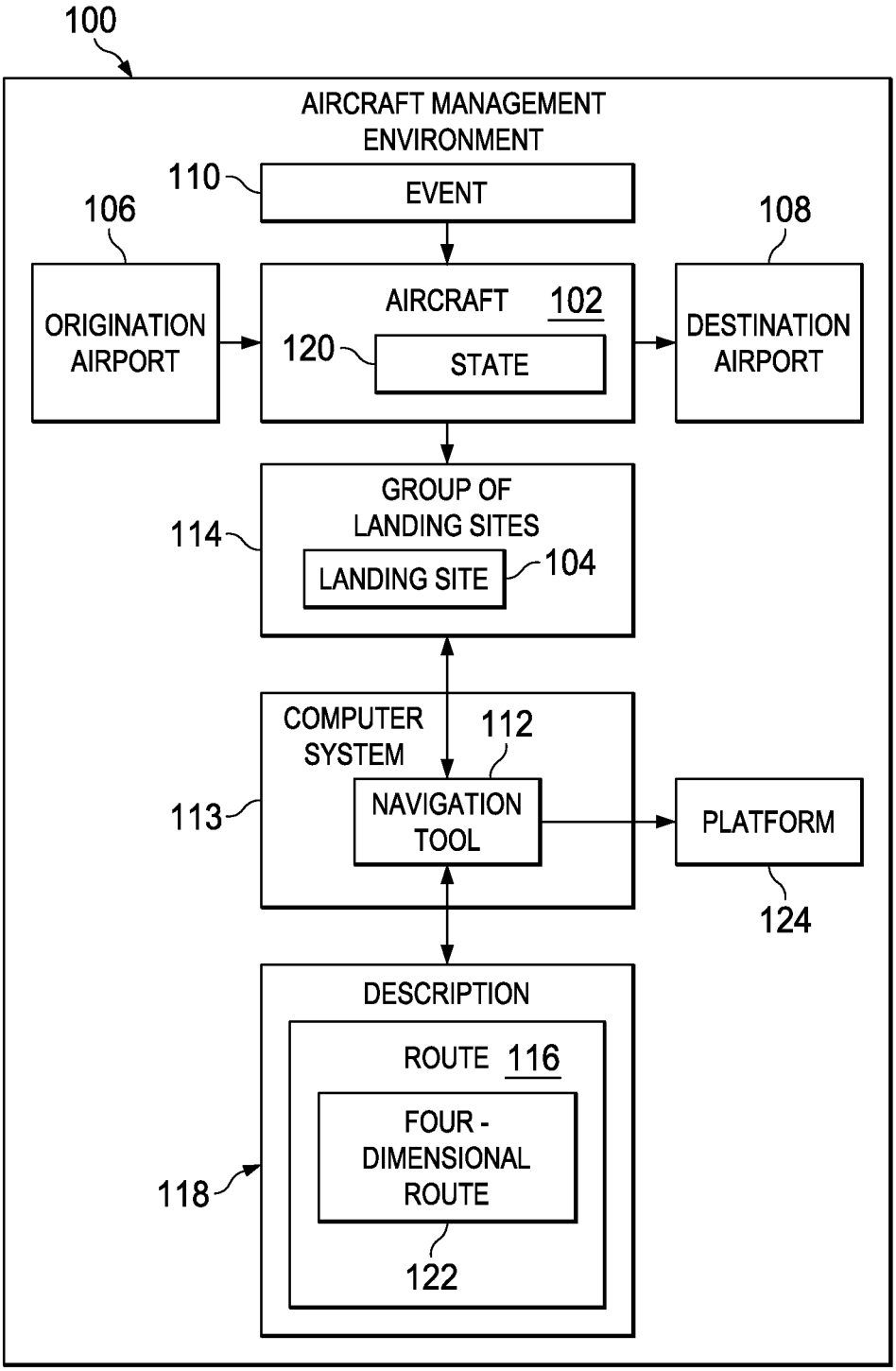
FIG. 1 is an illustration of a block diagram of an aircraft management environment in accordance with an illustrative embodiment.

The illustrative embodiments recognize and take into account one or more different considerations. For example, the illustrative embodiments recognize and take into account that a route selection tool may be provided to the pilot to select a suitable landing site when an event requires the pilot to deviate from the planned destination airport.

The illustrative embodiments also recognize and take into account that the selection of the landing site is only one part of the process that occurs in navigating the aircraft to that landing site. Further, the illustrative embodiments recognize and take into account that oftentimes, a straight point-to-point route from the current location of the aircraft to the landing site may be insufficient for desired flight of the aircraft. As a result, the route to the landing site is often more complex than a straight point-to-point route when obstacles that may be present between the aircraft and the landing site are taken into account.

For example, obstacles may be present between the aircraft and the landing site that may make flying the aircraft along the proposed route difficult or impossible. An obstacle is an object that may require the aircraft to change directions to avoid an unintended encounter with the object. This object may include terrain, other aircraft, a radio tower, trees, power lines, a weather balloon, and other objects. An obstacle also may be an airspace through which an aircraft should not fly. For example, the airspace may be a no-fly zone and other types of airspace that the aircraft is prohibited from flying through.

The illustrative embodiments also recognize and take into account that a tool may be provided to the pilot to select a landing site and a route to the landing site. This route may take the form of a flight path.

Additionally, the illustrative embodiments recognize and take into account that it is often desirable for the pilot to communicate the intent of the aircraft to fly to an alternate landing site to other parties outside of the aircraft. For example, the pilot may provide this intent to an air traffic controller, an airport, another aircraft, a ground station, or some other suitable party.

Currently, the pilot provides this information through verbal communications over a radio. The pilot may give some waypoints between the current location of the aircraft and the alternate landing site. The illustrative embodiments recognize and take into account, however, that the accuracy at which this information is provided may not be as accurate or as uniform as desired during these situations.

The illustrative embodiments also recognize and take into account that aircraft traffic currently has higher densities than before. With modern high-density traffic operations, the maximum amount of efficiency and completeness is needed in communicating the current state of an aircraft as well as the future trajectory or intent of an aircraft. The current state of the aircraft and the future trajectory of the aircraft are typically needed as quickly as possible for use by various parties. For example, during an engine out event, the pilot of the aircraft affected by the event, other pilots, air traffic controllers, and other parties need to know as quickly as possible where the aircraft can fly, should fly, and will actually fly. In other words, knowing different landing options, the best landing options, and details about the route to be flown for each option may be extremely beneficial in managing the aircraft affected by the event, as well as other aircraft. Verbal communications may not provide this information as quickly and as clearly as desired, or may not provide this information at all.

Thus, the illustrative embodiments recognize and take into account that it would be desirable to have a method and apparatus to provide route information of an aircraft to different parties with a desired level of accuracy, a desired level of standardization, or some combination thereof.

One or more illustrative embodiments provide a method and apparatus for managing a landing site for an aircraft. This management may include identifying the landing site and communicating information about the landing site. A landing site may be selected from a group of landing sites. A description of the landing site is communicated to a platform. The description is a description of a state of the aircraft along a route of the aircraft over time to the landing site. The aircraft may be flown to the landing site using the description of the state of the aircraft along the route of the aircraft over time. Further, this description also may be used by the platform for other operations.

With reference now to the figures, and in particular, with reference to FIG. 1, an illustration of a block diagram of an aircraft management environment is depicted in accordance with an illustrative embodiment. In this depicted example, aircraft management environment 100 may be used to manage aircraft 102. In particular, aircraft management environment 100 is an environment in which the operation of aircraft 102 may be managed during flight to land at landing site 104.

In these illustrative examples, aircraft 102 may fly from origination airport 106 to destination airport 108. During flight of aircraft 102 toward destination airport 108, event 110 may occur which makes landing at destination airport 108 infeasible or undesirable. With the occurrence of event 110, aircraft 102 may be diverted to land at landing site 104.

In these illustrative examples, event 110 may take a number of different forms. For example, event 110 may be selected from one of an occurrence of turbulence, a presence of an undesired configuration in the aircraft, an issue at destination airport 108 that prevents aircraft 102 from landing at destination airport 108, the occurrence of undesired weather conditions, and other events that may make landing at destination airport 108 infeasible or undesirable. For example, landing at destination airport 108 may be infeasible to perform with a desired level of safety based on event 110.

In these illustrative examples, navigation tool 112 may be used to perform at least one of selecting landing site 104 and assisting aircraft 102 to land at landing site 104. As used herein, the phrase "at least one of", when used with a list of items, means different combinations of one or more of the listed items may be used and only one of each item in the list may be needed. For example, "at least one of item A, item B, and item C" may include, without limitation, item A or item A and item B. This example also may include item A, item B, and item C or item B and item C. In other examples, "at least one of" may be, for example, without limitation, two of item A, one of item B, and ten of item C; four of item B and seven of item C; and other suitable combinations.

In these illustrative examples, navigation tool 112 may be implemented using hardware, software, or a combination of the two. When software is used, the operations performed by navigation tool 112 may be implemented in program code configured to run on a processor unit. When hardware is employed, the hardware may include circuits that operate to perform the operations in navigation tool 112.

In the illustrative examples, the hardware may take the form of a circuit system, an integrated circuit, an application specific integrated circuit (ASIC), a programmable logic device, or some other suitable type of hardware configured to perform a number of operations. With a programmable logic device, the device is configured to perform the number of operations. The device may be reconfigured at a later time or may be permanently configured to perform the number of operations. Examples of programmable logic devices include, for example, a programmable logic array, a programmable array logic, a field programmable logic array, a field programmable gate array, and other suitable hardware devices. Additionally, the processes may be implemented in organic components integrated with inorganic components and/or may be comprised entirely of organic components excluding a human being. For example, the processes may be implemented as circuits in organic semiconductors.

In this illustrative example, navigation tool 112 may be implemented within computer system 113. Computer system 113 may include one or more computers. When more than one computer is present in computer system 113, the computers may communicate with each other using a communications medium such as a network.

In these illustrative examples, navigation tool 112 may select landing site 104 from group of landing sites 114. As used herein, a "group of" when used with reference to items means one or more items. For example, group of landing sites 114 is one or more landing sites. In these illustrative examples, navigation tool 112 generates route 116 to landing site 104. Route 116 may be described using description 118 of state 120 of aircraft 102 along route 116 of aircraft 102 over time to landing site 104. In other words, route 116 may be four-dimensional route 122 that is described by description 118 in these illustrative examples.

As depicted, description 118 of state 120 of aircraft 102 over route 116 over time may be communicated to platform 124 by aircraft 102. As depicted, platform 124 may take a number of different forms. For example, without limitation, platform 124 may be selected from one of an air traffic control tower, a ground station, a second aircraft, aircraft 102, or some other suitable platform.

For example, if navigation tool 112 is located remotely to aircraft 102, navigation tool 112 may communicate description 118 to aircraft 102 as platform 124. In yet other illustrative examples, platform 124 may be, for example, a ground station such as an unmanned aerial vehicle control station. Description 118 may be communicated to platform 124 where the operator of platform 124 may use description 118 to control the flight of aircraft 102 to landing site 104.

In yet another illustrative example, platform 124 may be another aircraft in addition to aircraft 102. Description 118 may be used by the second aircraft to perform collision avoidance with respect to aircraft 102. In other words, description 118 of state 120 of aircraft 102 along route 116 over time may be used to more accurately determine whether a second aircraft performs changes to its route to maintain a desired level of separation from aircraft 102.

In still another illustrative example, when platform 124 takes the form of an air traffic control tower, an operator in the air traffic control tower may use description 118 to provide more accurate management of aircraft. With description 118, the amount of separation between aircraft 102 and other aircraft may be reduced with a desired level of safety in operating the different aircraft.

In these illustrative examples, navigation tool 112 may be located in a number of different locations. For example, navigation tool 112 may be located in at least one of aircraft 102, a ground station, another aircraft, or some other suitable location. In some illustrative examples, navigation tool 112 may be located in more than one location as a distributed tool.

In this manner, navigation tool 112 may provide route 116 for use by aircraft 102 to land at landing site 104 when event 110 occurs and prevents aircraft 102 from reaching destination airport 108. In these illustrative examples, description 118 of route 116 of state 120 of aircraft 102 over time to reach landing site 104 may be used by aircraft 102 to reach landing site 104.

Further, navigation tool 112 also provides description 118 of route 116 to platform 124. Description 118 describes state 120 of aircraft 102 along route 116 for aircraft 102 over time to landing site 104.

Description 118 may be used by platform 124 to perform different operations. For example, if platform 124 is an airport that is selected as landing site 104, the airport may make preparations for the landing of aircraft 102. In another illustrative example, if platform 124 is an air traffic control station, adjustments may be made to the flight of other aircraft to clear airspace for aircraft 102 to fly to landing site 104.

In these illustrative examples, description 118 is provided in a manner that allows for platform 124, as well as other platforms, to use the information to perform different operations. For example, description 118 may be used to perform air traffic control operations for managing the flight of other aircraft relative to aircraft 102. In these illustrative examples, description 118 is not provided verbally by an operator of aircraft 102. Instead, description 118 takes the form of information that may be transmitted as data in a message to platform 124 for use.

Figure 2:
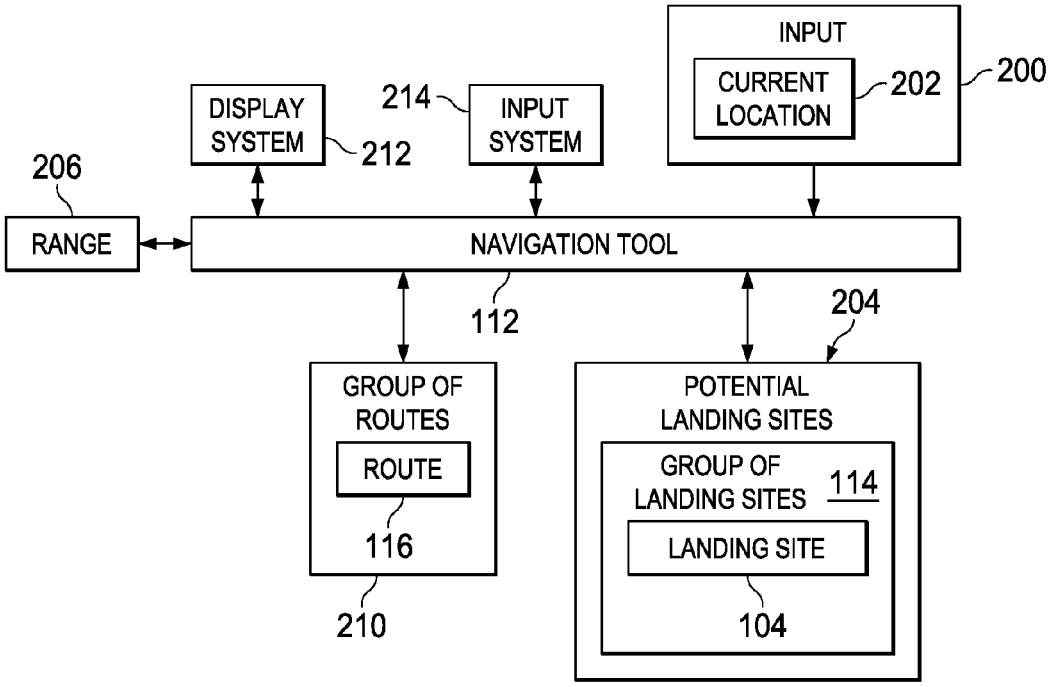
FIG. 2 is an illustration of a block diagram of operations performed by a navigation tool in accordance with an illustrative embodiment.

Turning now to FIG. 2, an illustration of a block diagram of operations performed by a navigation tool is depicted in accordance with an illustrative embodiment. In these illustrative examples, navigation tool 112 is configured to generate group of landing sites 114 and group of routes 210.

In these illustrative examples, group of routes 210 is one or more routes to group of landing sites 114. In other words, each route in group of routes 210 is a route from current location 202 of aircraft 102 in FIG. 1 to a landing site in group of landing sites 114.

As depicted, current location 202 may be used by navigation tool 112 to identify group of landing sites 114 from potential landing sites 204. Potential landing sites 204 are locations where an aircraft, such as aircraft 102, may land. Potential landing sites 204 are typically airports. However, in some illustrative examples, potential landing sites 204 may also include fields, highways, and other suitable locations for landing aircraft 102.

Group of landing sites 114 may be based on range 206 identified for aircraft 102. Range 206 is the current range for aircraft 102 during flight. In other words, the current range is how far aircraft 102 can fly from its current location at the time group of landing sites 114 is identified.

With range 206 for aircraft 102, navigation tool 112 selects group of landing sites 114 from potential landing sites 204. Group of landing sites 114 is landing sites within range 206 of aircraft 102.

Range 206 may take a number of different forms. For example, range 206 may be the distance that aircraft 102 can fly based on current fuel in aircraft 102. In other illustrative examples, range 206 may be a distance less than how far aircraft 102 may fly. For example, range 206 may include a margin of safety.

Additionally, group of landing sites 114 also may be selected based on characteristics of aircraft 102. For example, the length of a runway needed by aircraft 102 to land may be used to identify group of landing sites 114 from potential landing sites 204.

In these illustrative examples, aircraft 102 is configured to update group of routes 210 to group of landing sites 114. This update of group of routes 210 to group of landing sites 114 may be based on current location 202 of aircraft 102. In other words, as current location 202 of aircraft 102 changes, routes within group of routes 210 change to reflect current location 202 of aircraft 102.

This updating of group of routes 210 by navigation tool 112 may be performed periodically. The time period at which group of routes 210 is updated may be such that updates are performed as quickly as possible. In these illustrative examples, this updating of group of routes 210 may be considered to be a continuous updating of group of routes 210.

Further, navigation tool 112 also may update group of landing sites 114 in a similar fashion. In other words, group of landing sites 114 may be updated continuously based on current location 202 of aircraft 102. For example, a landing site in group of landing sites 114 may become infeasible for use because the landing site is out of range 206 for aircraft 102 based on current location 202 of aircraft 102. Thus, as current location 202 of aircraft 102 changes during flight, group of landing sites 114 also may change.

Additionally, navigation tool 112 also may prioritize group of routes 210 to group of landing sites 114. This prioritization of group of routes 210 may be based on various factors. These factors may include at least one of ability to land at a landing site and group of obstacles. The group of obstacles may include at least one of terrain, other aircraft, no-fly zones, an area of undesired weather, and other obstacles that may be located between aircraft 102 and a landing site in group of landing sites 114. In other words, the prioritization of group of routes 210 may take into account a group of obstacles along route 116 from current location 202 to landing site 104.

In these illustrative examples, a portion of group of landing sites 114, group of routes 210, or some combination thereof may be displayed on display system 212 by navigation tool 112. Display system 212 may be viewed by an operator of aircraft 102 or some other person. Display system 212 is a hardware system and may include one or more display devices in these illustrative examples. A selection of landing site 104, route 116 or both from the portion of group of landing sites 114, group of routes 210, or some combination thereof may be received through input system 214. In this manner, a selection of landing site 104, route 116, or both may be made. In some illustrative examples, the portion may be landing site 104, route 116 or both and may not include other landing sites or routes. Input system 214 is a hardware system and may include input devices such as a mouse, a keyboard, a touch screen, a track ball, and other suitable types of input devices.

In this depicted example, navigation tool 112 is configured to select landing site 104 from group of landing sites 114 based on input 200. For example, input 200 includes current location 202. Current location 202 is a current location of aircraft 102.

In these illustrative examples, when route 116 for landing site 104 is selected for use by aircraft 102, navigation tool 112 is also configured to generate description 118 for route 116 for state 120 of aircraft 102 along route 116 of aircraft 102 over time to landing site 104. Aircraft 102 may then use description 118 to fly along route 116 to landing site 104 in a desired manner. By using description 118, aircraft 102 may fly more precisely than currently used navigation systems that use only point-to-point navigation for routing an aircraft.

Figure 3:
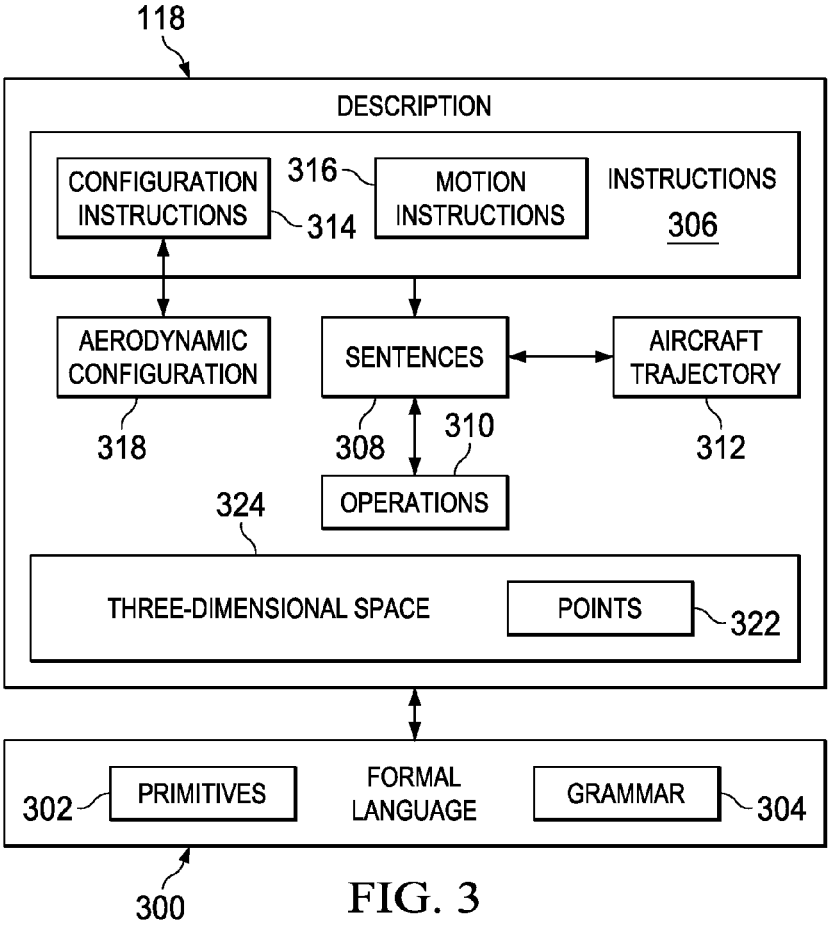
FIG. 3 is an illustration of a block diagram of a description in accordance with an illustrative embodiment.

With reference now to FIG. 3, an illustration of a block diagram of a description is depicted in accordance with an illustrative embodiment. As depicted, description 118 may be written in formal language 300.

In these illustrative examples, description 118 describes the intent of aircraft 102. In particular, description 118 is used to specify route 116 of aircraft 102 over time with a desired level of accuracy. Route 116 may be described as points 322 in three-dimensional space 324 over time.

As depicted, description 118 also includes a description of state 120 of aircraft 102 needed to fly on route 116 to landing site 104. Description 118 may describe state 120 with the granularity or specificity that allows aircraft 102 to fly on route 116 with a desired level of accuracy.

In these illustrative examples, formal language 300 may take a number of different forms. For example, formal language 300 may take the form of an aircraft intent description language (AIDL). In these illustrative examples, formal language 300 may define primitives 302 and grammar 304. As depicted, primitives 302 may take the form of instructions 306. Grammar 304 may be used to combine instructions 306 into sentences 308 that describe operations 310.

Each operation in operations 310 is comprised of a group of sentences 308 that define route 116 in the form of aircraft trajectory 312 for aircraft 102 over a period of time. This period of time may be some or all of the time that aircraft 102 flies along route 116. In these illustrative examples, this period of time may also be defined as an operation interval.

In these illustrative examples, aircraft trajectory 312 is a path of aircraft 102 through space as a function of time. Aircraft trajectory 312 may be defined with a desired level of accuracy in description 118 using instructions 306 grouped into sentences 308.

As depicted, instructions 306 include a number of different types of instructions. For example, instructions 306 may include at least one of configuration instructions 314 and motion instructions 316.

Configuration instructions 314 relate to aerodynamic configuration 318 for aircraft 102. The aerodynamic configuration may be a configuration of different components in aircraft 102. These components may include at least one of control surfaces, landing gear, and other components that may change configuration on aircraft 102 in a manner that affects the manner in which aircraft 102 moves when flying. The control surface may include at least one of a rudder, an elevator, a slat, an aileron, a speed brake, and other suitable types of control surfaces. The configuration of these different control surfaces is identified during the period of time.

Motion instructions 316 include flight control commands, guidance modes, navigation strategies, propulsion settings, and other items that may relate to, or control the motion of, aircraft 102. Aircraft trajectory 312 may be described for aircraft 102 using configuration instructions 314 and motion instructions 316 in FIG. 3 in these illustrative examples.

Figure 4:
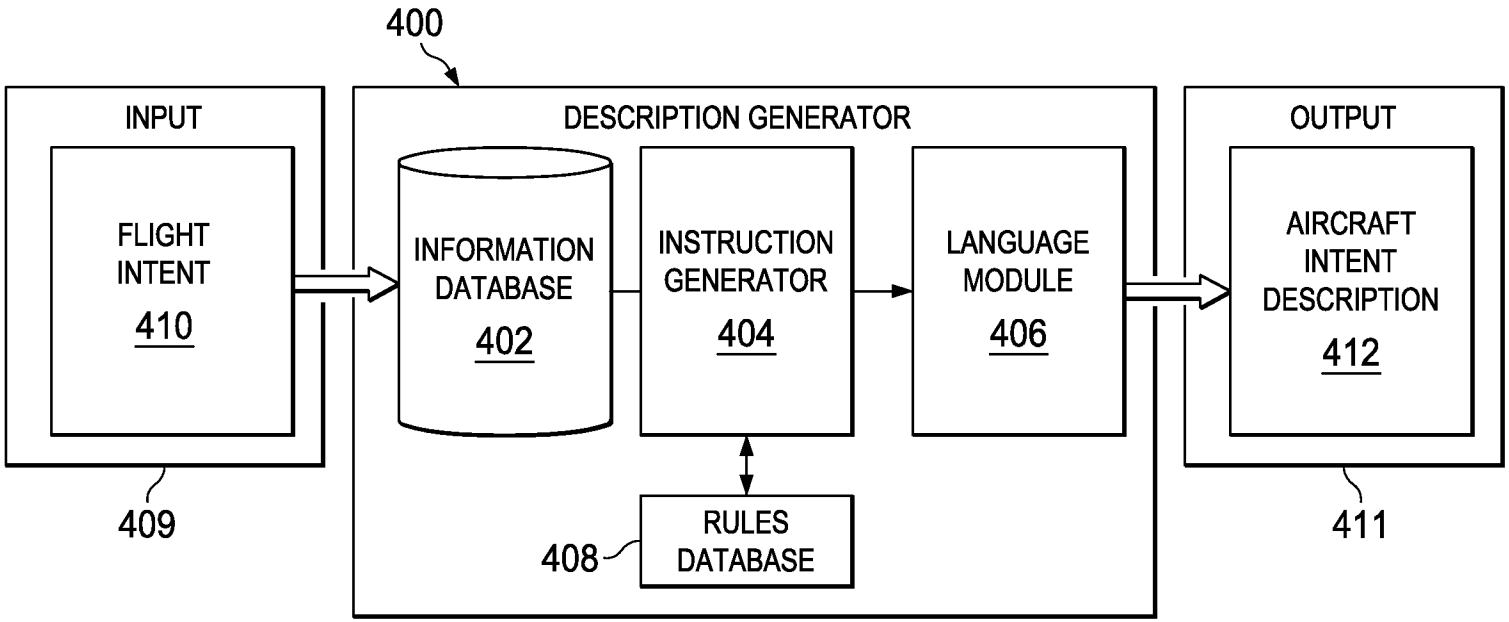
FIG. 4 is an illustration of a block diagram of a description generator in accordance with illustrative embodiment.

Turning now to FIG. 4, an illustration of a block diagram of a description generator is depicted in accordance with an illustrative embodiment. In this illustrative example, description generator 400 is an example of a component that may be implemented in navigation tool 112 to generate description 118 in FIG. 1.

As depicted, description generator 400 may include a number of different components. In this example, description generator 400 includes information database 402, instruction generator 404, language module 406, and rules database 408.

In this depicted example, description generator 400 is configured to receive flight intent 410 as input 409 and generate description 118 in the form of aircraft intent description 412. Flight intent 410 is information defining how aircraft 102 is to be flown during a particular time interval or period of time. This time interval or period of time may be a portion or all of the flight from current location 202 in FIG. 2 of aircraft 102 to another location. This other location may be a location in the air, an airport, or some other suitable landing site. In these illustrative examples, flight intent 410 may take the form of route 116 in FIG. 1.

As depicted, information database 402 is configured to store information received by description generator 400. In this illustrative example, information database 402 is configured to receive information in flight intent 410.

Instruction generator 404 is configured to generate instructions for use in forming aircraft intent description 412. In these illustrative examples, the instructions may include configuration instructions 314 and motion instructions 316 of FIG. 3.

Additionally, instruction generator 404 is configured to ensure that the instructions generated from information stored in information database 402 conform to one or more rules in rules database 408. The rules in rules database 408 may include rules that define aerodynamic configuration 318 for aircraft 102 and motion instructions 316 for aircraft 102 used to limit or close the degrees of freedom for the equations of motion used to describe aircraft motion during the particular time interval.

In this example, the equations of motion describe the state of aircraft 102 with regard to position, velocity, acceleration, orientation, rotation rate, and rotational acceleration as a function of time. In other words, the equations of motion describe aircraft intent description 412 as a four-dimensional path for aircraft 102. To achieve aircraft intent description 412, a set of aircraft control inputs are specified. These control inputs close the degrees of freedom of aircraft 102 and allow the equations of motion to describe aircraft intent description 412 with a desired level of accuracy. When one or more degrees of freedom are not specified by control variables, aircraft intent description 412 may not be described as efficiently and accurately as desired.

As depicted, language module 406 is configured to process the instructions generated by instruction generator 404. For example, language module 406 is configured to place instructions generated by instruction generator 404 in a format such as a formal language. Aircraft intent description 412 may then be communicated through output 411 for use by other platforms.

Figure 5:
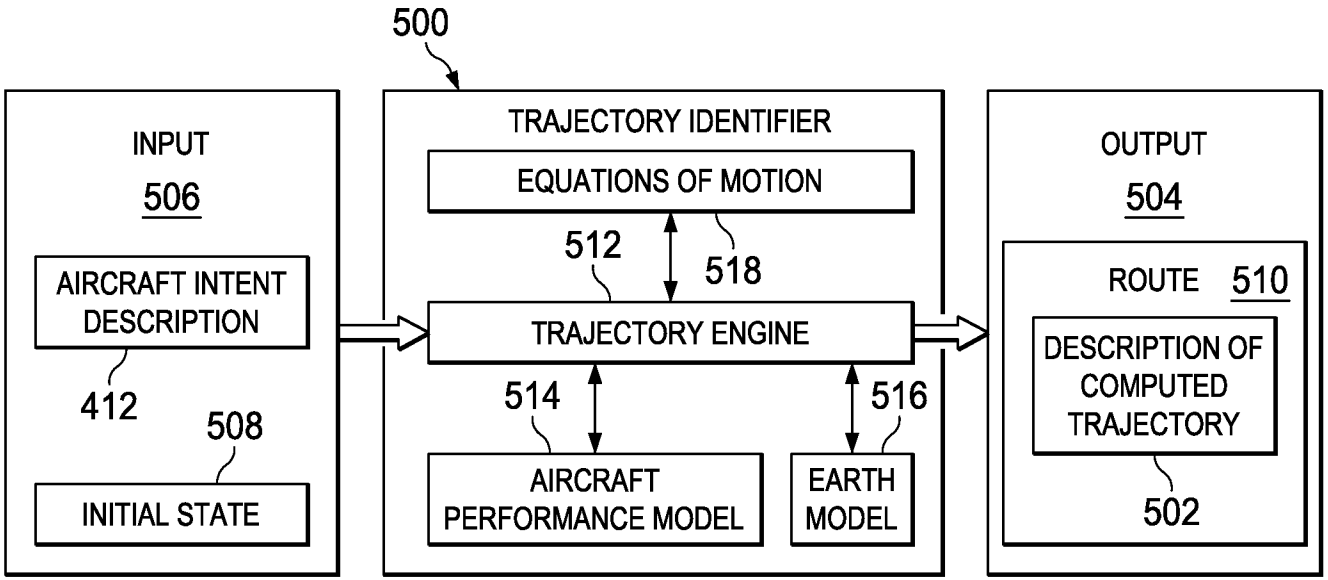
FIG. 5 is an illustration of a block diagram of a trajectory identifier in accordance with an illustrative embodiment.

Turning now to FIG. 5, an illustration of a block diagram of a trajectory identifier is depicted in accordance with an illustrative embodiment. In this depicted example, trajectory identifier 500 may be used to generate description 118 of route 510. Route 510 is a four-dimensional route that may take the form of description of computed trajectory 502 over a period of time for an aircraft.

In particular, trajectory identifier 500 may be implemented by any platform to identify the route of an aircraft in four-dimensions with a desired level of accuracy. For example, trajectory identifier 500 may be implemented in platform 124 in FIG. 1.

As depicted, trajectory identifier 500 may be implemented using hardware, software, or a combination of the two. In these illustrative examples, trajectory identifier 500 generates output 504 in the form of description of computed trajectory 502 from input 506.

In this illustrative example, input 506 includes aircraft intent description 412 and initial state 508. Aircraft intent description 412 is a description of a route for the aircraft. Initial state 508 is the initial state of the aircraft. Initial state 508 may be the current state of the aircraft.

For example, initial state 508 may include position, velocity, acceleration, orientation, rotation rate, rotational acceleration, and other suitable parameters of the aircraft. Initial state 508 may also include control inputs used to close all of the degrees of freedom for the aircraft. In this illustrative example, initial state 508 may include a lateral control mode, a vertical control mode, a speed control mode, and an aerodynamic configuration. As a result, initial state 508 may include control input such as heading-hold, fly-to-waypoint, altitude-hold, set-vertical-speed, set thrust, set speed, a configuration for flaps, gear, and spoilers, and other suitable control inputs for the aircraft.

In this depicted example, output 504 is generated from input 506 using a number of components in trajectory identifier 500. As illustrated, trajectory identifier 500 includes trajectory engine 512, aircraft performance model 514, and earth model 516.

Aircraft performance model 514 is a model that describes the movement of an aircraft. For example, aircraft performance model 514 may describe how an aircraft moves based on different configurations of surface controls, different settings for the propulsion system in the aircraft, and other parameters about the aircraft.

Earth model 516 is configured to generate information about the environment around an aircraft. For example, earth model 516 may include information such as, wind, temperature, pressure, gravity, magnetic variation, and other suitable parameters.

Trajectory engine 512 uses aircraft performance model 514 and earth model 516 in conjunction with equations of motion 518 to generate description of computed trajectory 502. In these illustrative examples, equations of motion 518 describe the motion of the center of gravity of an aircraft with the aircraft being considered a mass-varying rigid solid. Equations of motion 518 may include equations that describe dynamics, mass variation, navigation, and other items about an aircraft. These equations may be implemented in various forms depending on the particular implementation. These equations may vary depending on whether the aircraft is a fixed wing aircraft, such as an airplane, or a rotorcraft, such as a helicopter.

The illustration of aircraft management environment 100 and the different components used in aircraft management environment 100 and FIGS. 1-5 are not meant to imply limitations the manner in which an illustrative embodiment may be implemented. Other components in addition to or in place of the ones illustrated may be used. Some components may be unnecessary. Also, the blocks are presented to illustrate the functional components. One or more of these blocks may be combined, divided, or combined and divided into different blocks when implemented in an illustrative embodiment.

For example, navigation tool 112 in computer system 113 may be in different locations depending on the particular implementation. As an example, navigation tool 112 may be located in at least one of aircraft 102, a ground station, another aircraft, or some other suitable location. In other words, navigation tool 112 may be located in any one of or a combination of all of these different locations depending on the implementation. Computer system 113 may be a distributed computer system in some examples such that computer system 113 may be in multiple locations. When navigation tool 112 is located only in aircraft 102, computer system 113 may be a navigation system or some other type of system in aircraft 102.

Figure 6:
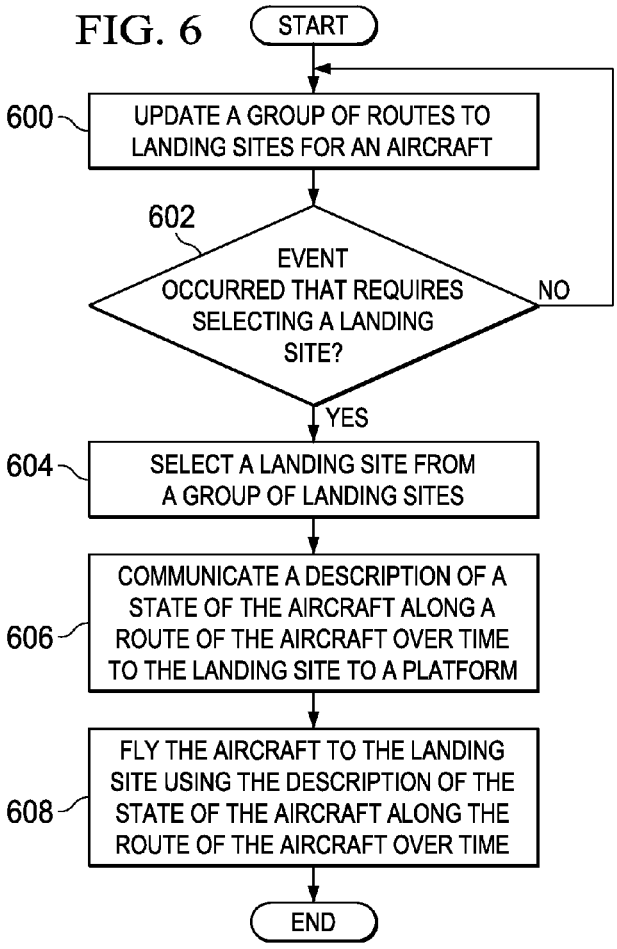
FIG. 6 is an illustration of a flowchart of a process for managing a landing site for an aircraft in accordance with illustrative embodiment.

With reference now to FIG. 6, an illustration of a flowchart of a process for managing a landing site for an aircraft is depicted in accordance with an illustrative embodiment. In this particular example, the different operations illustrated in FIG. 6 may be implemented in aircraft management environment 100 in FIG. 1. For example, one or more of the different operations may be implemented in navigation tool 112, aircraft 102, or some combination thereof.

The process begins by updating a group of routes for landing sites for an aircraft (operation 600). A determination is made as to whether an event has occurred that requires selecting a landing site (operation 602).

If an event has occurred that requires selecting a landing site, the process selects a landing site from a group of landing sites (operation 604). The landing site selected in operation 604 may be selected based on a current location of the aircraft.

The process communicates a description of a state of the aircraft along a route of the aircraft over time to the landing site to a platform (operation 606). In other words, this description identifies the state of the aircraft and a route. In some illustrative examples, the description may include the route. In other illustrative examples, the state of the aircraft over time may be used to derive the route.

In these illustrative examples, the landing site may be an emergency landing site that is selected in place of the destination airport because the aircraft is unable to reach the destination airport or the destination airport is unable to receive the aircraft. In this example, the aircraft may be a first aircraft and the description is communicated from a location selected from one of the first aircraft, a ground station, an air traffic control station, and a second aircraft.

Next, the aircraft is flown to the landing site using the description of the state of aircraft along the route of the aircraft over time (operation 608), with the process terminating thereafter. With reference again to operation 602, if an event has not occurred, the process returns to operation 600.

Figure 7:
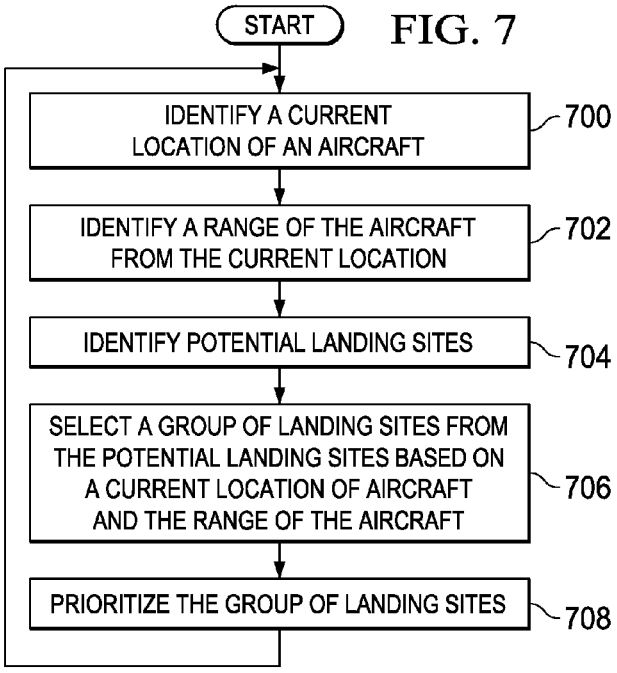
FIG. 7 is an illustration of a flowchart of a process for generating a group of landing sites for aircraft in accordance with illustrative embodiment.

Turning now to FIG. 7, an illustration of a flowchart of a process for generating a group of landing sites for aircraft is depicted in accordance with an illustrative embodiment. The process illustrated in FIG. 7 may be implemented in navigation tool 112 in FIG. 1.

The process begins by identifying a current location of an aircraft (operation 700). The current location of the aircraft may be identified in a number of different ways. For example, the aircraft may include a location identification system such as a global positioning system receiver.

Next, a range of the aircraft from the current location is identified (operation 702). The range of the aircraft is the distance that the aircraft may fly. This distance varies over time. As the aircraft flies, the amount of fuel left in the fuel tanks decreases. As a result, the range of the aircraft decreases over time in these illustrative examples.

The process then identifies potential landing sites (operation 704). The potential landing sites are any locations on the ground where the aircraft may potentially land. The identification of potential landing sites may be based on aircraft parameters, amount of fuel in the fuel tanks, obstacles between the aircraft and a landing site, or some other suitable characteristic of the aircraft or the environment around the aircraft.

A group of landing sites is selected from the potential landing sites based on a current location of aircraft and the range of the aircraft (operation 706). Next, the group of landing sites is prioritized (operation 708). The process then returns to operation 700.

Figure 8:
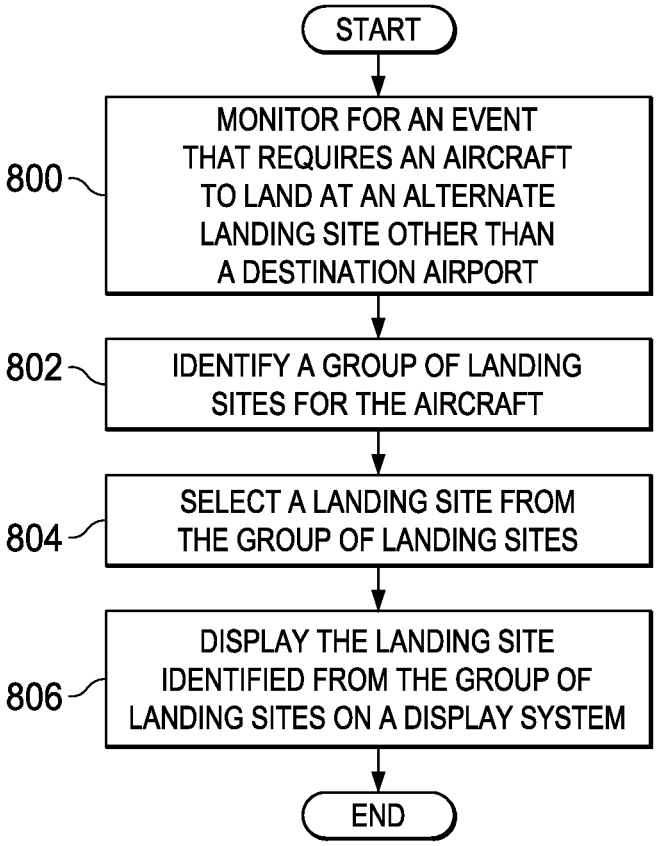
FIG. 8 is an illustration of a flowchart of a process for selecting a landing site in accordance with an illustrative embodiment.

With reference next to FIG. 8, an illustration of a flowchart of a process for selecting a landing site is depicted in accordance with an illustrative embodiment. The process illustrated in FIG. 8 may be implemented in navigation tool 112 in FIG. 1.

The process begins by monitoring for an event that requires an aircraft to land at an alternate landing site other than a destination airport (operation 800). In these illustrative examples, events may be monitored in a number of different ways. For example, events may be monitored using sensor systems in aircraft 102. As an example, sensor systems may be present that monitor for at least one of an occurrence of an electromagnetic event, an undesired reduction in engine performance, an undesired performance of a surface control system, and other types of events.

In other illustrative examples, the event may be a message communication that indicates that it is no longer feasible to land at the destination airport. For example, the message may be a weather report indicating that a thunderstorm is present and located such that the destination airport cannot be reached with a desired level of safety.

In another illustrative example, the message may be from an air traffic controller indicating that the destination airport is no longer available for landing. In yet another illustrative example, the event may be a pilot of the aircraft indicating that an undesired condition is present in the aircraft that requires an alternate landing site.

The process then identifies a group of landing sites for the aircraft (operation 802). In these illustrative examples, the group of landing sites may be selected using the process described with respect to the flowchart in FIG. 7. The process then selects a landing site from the group of landing sites (operation 804).

In these depicted examples, the landing site may be selected automatically or as a result of operator input. For example, when landing site selection is automatic, a landing site is selected using rule-based criteria. This selection may be performed using an apparatus such as a software system.

These criteria may include, for example, without limitation, shortest distance from the current position of the aircraft, most altitude margin, routes that minimize turning, weather condition avoidance, and other suitable criteria. The rules for these automated systems are based on best practices that a skilled operator would likely follow in the particular situation.

In other illustrative examples, when landing site selection involves operator input, the software system presents the operator with a prioritized list of landing sites using the same rule-based criteria. The operator then selects a landing site from the prioritized list. In still other illustrative examples, an operator may choose a landing site from a list of landing sites based on his own experience and preferences. In this case, the software system does not prioritize the list of landing sites.

The process then displays the landing site identified from the group of landing sites on a display system (operation 806) with the process terminating thereafter. At this point, the operator of the aircraft may confirm the selection of the landing site. Further, the operator may direct the aircraft to the landing site or may employ a control system, such as an autopilot, to fly the aircraft to the landing site.

The flowcharts and block diagrams in the different depicted embodiments illustrate the architecture, functionality, and operation of some possible implementations of apparatuses and methods in an illustrative embodiment. In this regard, each block in the flowcharts or block diagrams may represent a module, a segment, a function, and/or a portion of an operation or step. For example, one or more of the blocks may be implemented as program code, in hardware, or a combination of the program code and hardware. When implemented in hardware, the hardware may, for example, take the form of integrated circuits that are manufactured or configured to perform one or more operations in the flowcharts or block diagrams.

In some alternative implementations of an illustrative embodiment, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

For example, operation 708 in FIG. 7 is an optional operation and may be omitted in some illustrative examples. In another illustrative example, operation 806 in FIG. 8 may also be omitted. In some illustrative examples, the aircraft may be automatically controlled to fly to the landing site without operator input to confirm the landing site.

Figure 9:
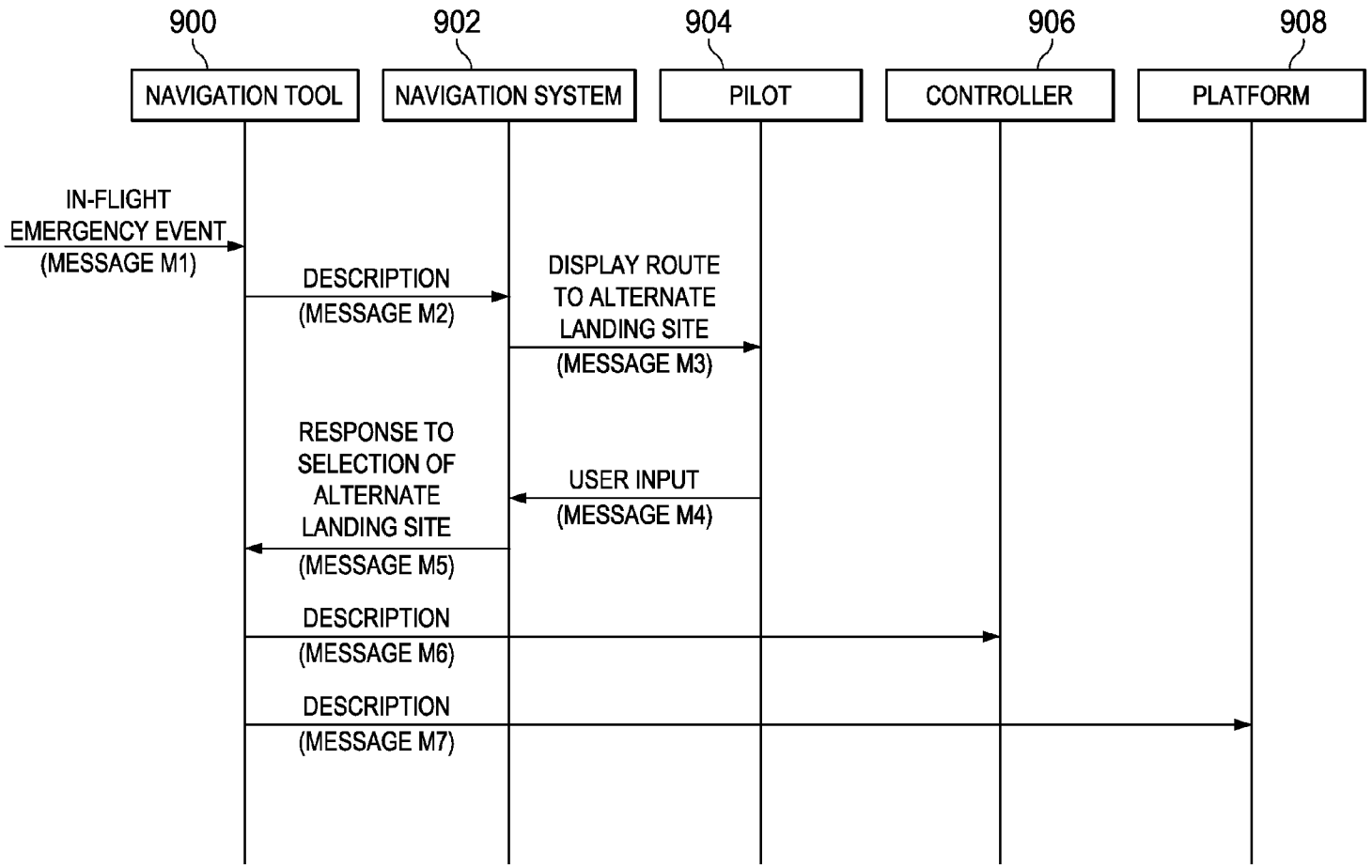
FIG. 9 an illustration of data flow in an aircraft management environment in accordance with an illustrative embodiment.

Turning now to FIG. 9, an illustration of data flow in an aircraft management environment is depicted in accordance with an illustrative embodiment. The data flow illustrated in this figure may be implemented in aircraft management environment 100 in FIG. 1. In this illustrative example, the aircraft may be, for example, a commercial aircraft in which navigation tool 900 is located. Navigation tool 900 may be, for example, navigation tool 112 in FIG. 1. In this illustrative example, data flows between different components in messages that are sent between the components.

As depicted, navigation tool 900 receives an in-flight emergency event (message M1). In these illustrative examples, the in-flight emergency event may be identified by at least one of the aircraft, an aircraft control ground station, air traffic control system, and other suitable parties. In these illustrative examples, the in-flight emergency event may be any event that results in rerouting the aircraft to another landing site other than the destination airport for the aircraft.

In these illustrative examples, the in-flight emergency event may be, for example, an engine operating incorrectly or not operating at all. This type of event may be identified by the aircraft. Of course, the in-flight emergency event may take other forms, such as weather conditions, changes in airspace restrictions, changes in conditions at the destination airport, and other events that may require changing the landing site for the aircraft. These other types of events may be identified by another party such as an aircraft ground control station, air traffic control station, or some other suitable party.

In these illustrative examples, navigation tool 900 selects an alternate landing site from a group of landing sites where the aircraft may land. In these illustrative examples, navigation tool 900 generates a description of the route to the landing site. For example, the description may take the form of aircraft intent description 412 in FIG. 4.

Navigation tool 900 sends the description to navigation system 902 (message M2). Navigation system 902 displays the route to the alternate landing site to pilot 904 in the aircraft (message M3). Navigation system 902 then receives user input from the pilot as to whether to use the selected landing site (message M4).

In response to receiving the user input, navigation system 902 returns a response to the selection of the alternate landing site to navigation tool 900 (message M5). This response indicates whether pilot 904 has confirmed the selection of the landing site.

If the response is a confirmation of the landing site, navigation tool 900 sends the description to controller 906 for the aircraft (message M6). Controller 906 uses the description to control the flight of the aircraft to the alternate landing site. In these illustrative examples, the controller may be, for example, pilot 904, an autopilot, or some other suitable component that controls the flight of the aircraft.

Additionally, when a confirmation is received, navigation tool 900 also sends the description to platform 908 (message M7). In this illustrative example, platform 908 may be, for example, an aircraft control ground station, an aircraft control system, or some other suitable ground station. Platform 908 may use the description to perform management of aircraft that may be flying near the route to the landing site.

As an example, if platform 908 is an air traffic control station, platform 908 may use the description to clear the landing site in order for the aircraft to safely land at the landing site. In other illustrative examples, platform 908 may use the description to dispatch emergency personnel to the landing site.

In still other illustrative examples, platform 908 may be aircraft located at or near the landing site. For example, the description may be sent to aircraft at or near the landing site such that these aircraft may use the description to perform collision avoidance. In yet other illustrative examples, the description may be sent to other aircraft in the predicted path of the landing aircraft such that the other aircraft may also perform collision avoidance.

If the response returned by navigation system 902 does not confirm the selection of the landing site described in the description, navigation tool 900 selects another landing site and sends that description to navigation system 902 for confirmation by pilot 904. This process continues until pilot 904 confirms the selection of a landing site and the description is sent to controller 906.

Figure 10:
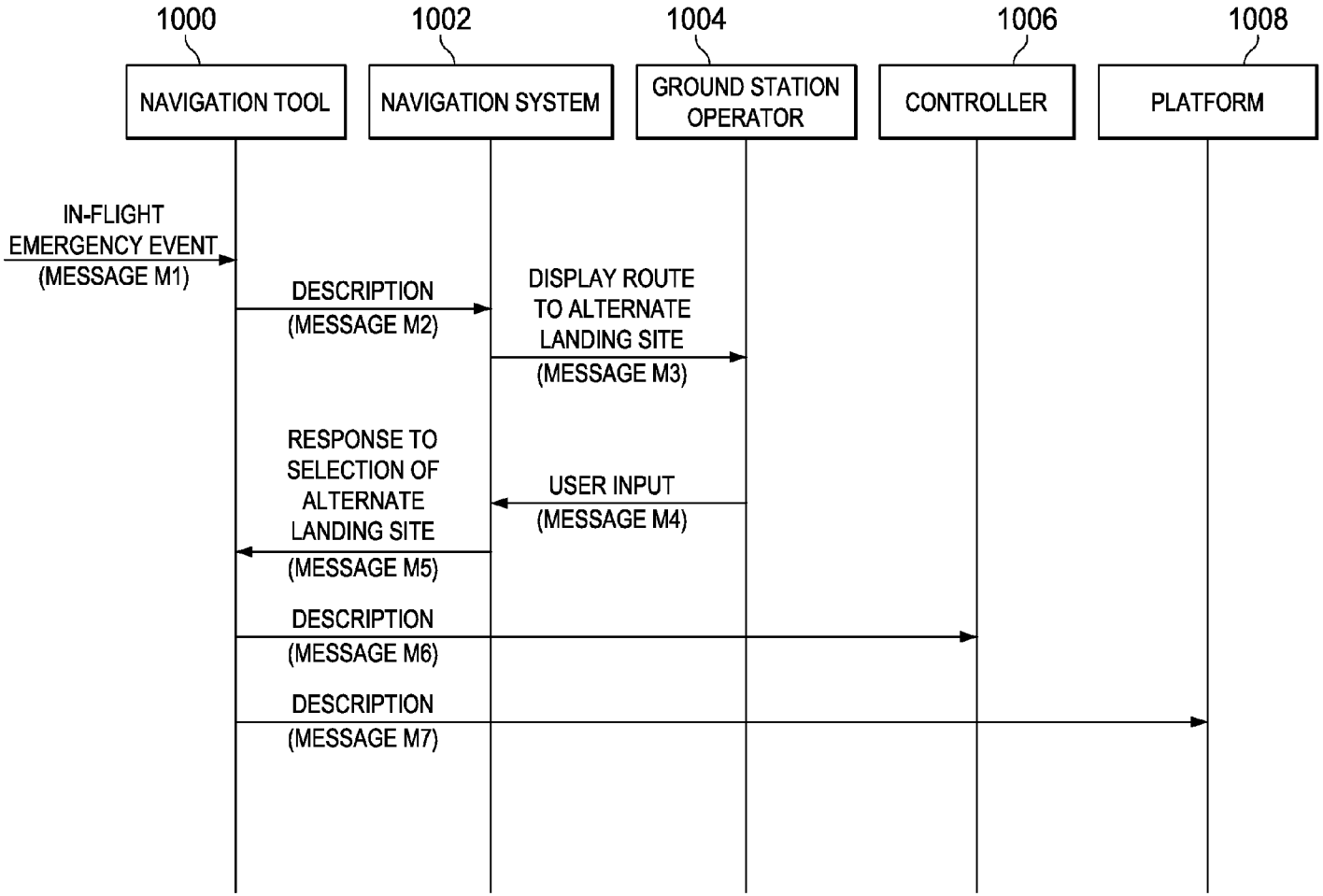
FIG. 10 is an illustration of data flow in an aircraft management environment in accordance with an illustrative embodiment.

With reference now to FIG. 10, an illustration of data flow in an aircraft management environment is depicted in accordance with an illustrative embodiment. The data flow illustrated in this figure may be implemented in aircraft management environment 100 in FIG. 1. In this illustrative example, the aircraft may be an unmanned aerial vehicle (UAV). The unmanned aerial vehicle may be operating alone or in a group of unmanned aerial vehicles.

As depicted, navigation tool 1000 may be an example of one implementation for navigation tool 112 in FIG. 1. Navigation tool 1000 may be implemented in a computer system located in a ground station in these illustrative examples.

In these depicted examples, navigation tool 1000 receives an in-flight emergency event (message M1). In this example, the in-flight emergency event may be identified by at least one of the unmanned aerial vehicle, a ground station operator, an air traffic control system, and other suitable parties. The in-flight emergency event may be any event that results in rerouting the unmanned aerial vehicle to another landing site other than the original destination location for the unmanned aerial vehicle.

In these illustrative examples, the in-flight emergency event may be, for example, an engine operating incorrectly or not operating at all. This type of event may be identified by the unmanned aerial vehicle. Of course, the in-flight emergency event may take other forms, such as weather conditions, changes in airspace restrictions, changes in conditions at the original landing site, re-routing of one or more unmanned aerial vehicles in the group of unmanned aerial vehicles, and other events that may require changing the landing site for the aircraft. These other types of events may be identified by other parties such as the ground station operator, the air traffic control system, or some other suitable party. In some illustrative examples, these other events may even be detected by sensor systems in the unmanned aerial vehicle.

As depicted, navigation tool 1000 selects an alternate landing site from a group of landing sites where the unmanned aerial vehicle may land. In these illustrative examples, navigation tool 1000 generates a description of a route to the landing site. For example, the description may take the form of aircraft intent description 412 in FIG. 4.

Navigation tool 1000 sends the description to navigation system 1002 (message M2). Navigation system 1002 displays the route to the alternate landing site to ground station operator 1004 at the ground station (message M3). In these illustrative examples, ground station operator 1004 is a pilot that remotely controls the unmanned aerial vehicle. In some illustrative examples, ground station operator 1004 may be a program running on a computer system that remotely controls the unmanned aerial vehicle. Next, navigation system 1002 receives user input from the ground station operator 1004 as to whether to use the selected landing site (message M4).

In response to receiving the user input, navigation system 1002 returns a response to the selection of the alternate landing site to navigation tool 1000 (message M5). This response indicates whether ground station operator 1004 has confirmed the selection of the landing site.

If the response is a confirmation of the landing site, navigation tool 1000 sends the description to controller 1006 for the unmanned aerial vehicle (message M6). In this case, controller 1006 may be a controller operated by ground station operator 1004, an autopilot located on the unmanned aerial vehicle, or some other suitable component that controls the flight of the unmanned aerial vehicle. Controller 1006 uses the description to control the flight of the unmanned aerial vehicle to the alternate landing site.

Further, when a confirmation is received from ground station operator 1004, navigation tool 1000 also sends the description to platform 1008 (message M7). In this illustrative example, platform 1008 may be, for example, another ground station, another ground station operator, other unmanned aerial vehicles, an air traffic control system, other aircraft, or some other suitable platform. Platform 1008 may use the description to perform management of aircraft that may be flying near the route to the landing site.

If the response returned by navigation system 1002 does not confirm the selection of the landing site described in the description, navigation tool 1000 selects another landing site and sends that description to navigation system 1002 for confirmation by ground station operator 1004. This process continues until ground station operator 1004 confirms the selection of a landing site and a description is sent to controller 1006 and platform 1008.

In some illustrative examples, ground station operator 1004 may use controller 1006 to control a group of unmanned aerial vehicles. In this case, controller 1006 may use the description to reroute unmanned aerial vehicles in the group of unmanned aerial vehicles. Rerouting of one or more vehicles in the group of unmanned aerial vehicles controlled by ground station operator 1004 may avoid collision with the unmanned aerial vehicle landing at the alternative landing site.

In still other illustrative examples, the description of the new route for the unmanned aerial vehicle may be classified. In this case, the description may not be sent to platform 1008, the description may be sent only when platform 1008 is a desired type of platform, or some combination thereof.

FIGS. 11 through 22 and the description of these figures illustrate one manner in which landing sites may be selected in accordance with an illustrative embodiment. Of course, the selection of landing sites may be formed using other mechanisms other than those described in FIGS. 11 through 22, depending on the particular implementation.

The following detailed description of FIGS. 11-22 is directed to systems, methods, and computer readable media for determining landing sites for aircraft. Utilizing the concepts and technologies described herein, routing methodologies and a routing tool may be implemented for identifying attainable landing sites within a dead stick or glide footprint for the aircraft. The identified attainable landing sites may include airport landing sites and off-airport landing sites.

According to embodiments described herein, the attainable landing sites are evaluated to allow identification and/or selection of a recommended or preferred landing site. In particular, the evaluation of the landing sites may begin with a data collection operation, wherein landing site data relating to the attainable landing sites and/or aircraft data relating to aircraft position and performance are collected. The landing site data may include, but is not limited to, obstacle data, terrain data, weather data, traffic data, population data, and other data, all of which may be used to determine a safe ingress flight path for each identified landing site. In these illustrative examples, this flight path is an example of a route, such as route 116 for aircraft 102 in FIG. 1. The flight path may be described using a description such as description 118 in FIG. 1.

The aircraft data may include, but is not limited to, global positioning system (GPS) data, altitude, orientation, and airspeed data, glide profile data, aircraft performance data, and other information.

In some embodiments, a flight path spanning tree is generated for safe ingress flight paths to the determined attainable landing sites. The flight path spanning tree is generated from the landing site and is backed into the flight path. In some embodiments, the spanning trees are generated before or during flight, and can take into account a planned or current flight path, a known or anticipated glide footprint for the aircraft, banking opportunities, and detailed flight-time information. In some embodiments, the spanning trees can be accompanied by an optional countdown timer for each displayed branch of the spanning tree, i.e., each flight path to a landing site, the countdown timer being configured to provide a user with an indication as to how long the associated flight path remains available as a safe ingress option for the associated landing site.

According to various embodiments, collecting data, analyzing the data, identifying possible landing sites, generating spanning trees for each identified landing site, and selecting a landing site may be performed during a flight planning process, in-flight, and/or in real-time aboard the aircraft or off-board. Thus, in some embodiments aircraft personnel are able to involve Air Traffic Control (ATC), Airborne Operations Centers (AOCs), and/or Air Route Traffic Control Centers (ARTCCs) in the identification, analysis, and/or selection of suitable landing sites. The ATC, AOCs, and/or ARTCCs may be configured to monitor and/or control an aircraft involved in an emergency situation, if desired. These and other advantages and features will become apparent from the description of the various embodiments below.

Throughout this disclosure, embodiments are described with respect to manned aircraft and ground-based landing sites. While manned aircraft and ground-based landing sites provide useful examples for embodiments described herein, these examples should not be construed as being limiting in any way. Rather, it should be understood that some concepts and technologies presented herein also may be employed by manned aircraft as well as other vehicles including spacecraft, helicopters, gliders, boats, and other vehicles. Furthermore, the concepts and technologies presented herein may be used to identify non-ground-based landing sites such as, for example, a landing deck of an aircraft earner.

In the following detailed description, references are made to the accompanying drawings that form a part hereof and that show, by way of illustration, specific embodiments or examples. In referring to the drawings, like numerals represent like elements throughout the several figures.

Figure 11:
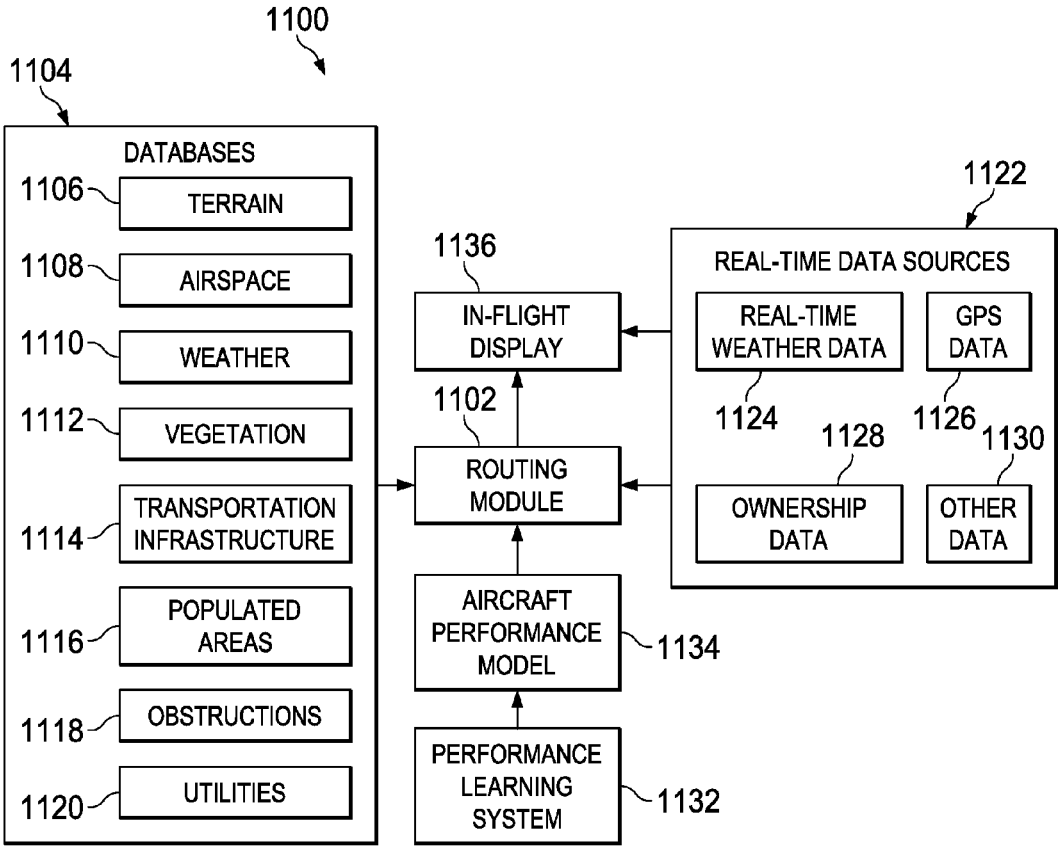
FIG. 11 is an illustration of a block diagram of a routing tool in accordance with an illustrative embodiment.

FIG. 11 schematically illustrates a block diagram of a routing tool 1100, according to an illustrative embodiment. The routing tool 1100 can be embodied in a computer system such as an electronic flight bag (EFB); a personal computer (PC); a portable computing device such as a notepad, netbook or tablet computing device; and/or across one or more computing devices, for example, one or more servers and/or web-based systems. As mentioned above, some, none, or all of the functionality and/or components of the routing tool 1100 can be provided by on board systems of the aircraft or by systems located off-board.

The routing tool 1100 includes a routing module 1102 configured to provide the functionality described herein including, but not limited to, identifying, analyzing, and selecting a safe landing site. In these illustrative examples, routing tool 1100 may be used to implement, or may be implemented as part of, navigation tool 112 in FIG. 1. In particular, routing tool 1100 may be used to identify landing site 104 and route 116 to landing site 104.

It should be understood that the functionality of the routing module 1102 may be provided by other hardware and/or software instead of, or in addition to, the routing module 1102. Thus, while the functionality described herein primarily is described as being provided by the routing module 1102, it should be understood that some or all of the functionality described herein may be performed by one or more devices other than, or in addition to, the routing module 1102.

The routing tool 1100 further includes one or more databases 1104. While the databases 1104 are illustrated as a unitary element, it should be understood that the routing tool 1100 can include a number of databases. Similarly, the databases 1104 can include a memory or other storage device associated with or in communication with the routing tool 1100, and can be configured to store a variety of data used by the routing tool 1100. In the illustrated embodiment, the databases 1104 store terrain data 1106, airspace data 1108, weather data 1110, vegetation data 1112, transportation infrastructure data 1114, populated areas data 1116, obstructions data 1118, utilities data 1120, and/or other data (not illustrated).

The terrain data 1106 represents terrain at a landing site, as well as along a flight path to the landing site. As will be explained herein in more detail, the terrain data 1106 can be used to identify a safe ingress path to a landing site, taking into account terrain, e.g., mountains, hills, canyons, rivers, and the like. The airspace data 1108 can indicate airspace that is available for generating one or more flight paths to the landing sites. The airspace data 1108 could indicate, for example, a military installation or other sensitive area over which the aircraft cannot legally fly.

The weather data 1110 can include data indicating weather information, particularly historical weather information, trends, and the like at the landing site, as well as along a flight path to the landing site. The vegetation data 1112 can include data indicating the location, height, density, and other aspects of vegetation at the landing site, as well as along a flight path to the landing site, and can relate to various natural obstructions including, but not limited to, trees, bushes, vines, and the like, as well as the absence thereof. For example, a large field may appear to be a safe landing site, but the vegetation data 1112 may indicate that the field is an orchard, which may preclude usage of the field for a safe landing.

The transportation infrastructure data 1114 indicates locations of roads, waterways, rails, airports, and other transportation and transportation infrastructure information. The transportation infrastructure data 1114 can be used to identify a nearest airport, for example. This example is illustrative, and should not be construed as being limiting in any way. The populated areas data 1116 indicates population information associated with various locations, for example, a landing site and/or areas along a flight path to the landing site. The populated areas data 1116 may be important when considering a landing site as lives on the ground can be taken into account during the decision process.

The obstructions data 1118 can indicate obstructions at or around the landing site, as well as obstructions along a flight path to the landing site. In some embodiments, the obstructions data include data indicating manmade obstructions such as power lines, cellular telephone towers, television transmitter towers, radio towers, power plants, stadiums, buildings, and other structures that could obstruct a flight path to the landing site. The utilities data 1120 can include data indicating any utilities at the landing site, as well as along a flight path to the landing site. The utilities data 1120 can indicate, for example, the locations, size, and height of gas pipelines, power lines, high-tension wires, power stations, and the like.

The other data can include data relating to pedestrian, vehicle, and aircraft traffic at the landing sites and along a flight path to the landing sites; ground access to and from the landing sites; distance from medical resources; combinations thereof; and the like. Furthermore, in some embodiments, the other data stores flight plans submitted by a pilot or other aircraft personnel. It should be understood that the flight plans may be submitted to other entities, and therefore may be stored at other locations instead of, or in addition to, the databases 1104.

The routing tool 1100 also can include one or more real-time data sources 1122. The real-time data sources 1122 can include data generated in real-time or near-real-time by various sensors and systems of or in communication with the aircraft. In the illustrated embodiment, the real-time data sources include real-time weather data 1124, GPS data 1126, ownship data 1128, and other data 1130.

The real-time weather data 1124 includes real-time or near-real-time data indicating weather conditions at the aircraft, at one or more landing sites, and along flight paths terminating at the one or more landing sites. The GPS data 1126 provides real-time or near-real-time positioning information for the aircraft, as is generally known. The ownship data 1128 includes real-time navigational data such as heading, speed, altitude, trajectory, pitch, yaw, roll, and the like. The ownship data 1128 may be updated almost constantly such that in the event of an engine or other system failure, the routing module 1102 can determine and/or analyze the aircraft trajectory. The ownship data 1128 further can include real-time or near-real-time data collected from various sensors and/or systems of the aircraft and can indicate airspeed, altitude, attitude, flaps and gear indications, fuel level and flow, heading, system status, warnings and indicators, and the like, some, all, or none of which may be relevant to identifying, analyzing, and/or selecting a landing site as described herein. The other data 1130 can include, for example, data indicating aircraft traffic at or near a landing site, as well as along a flight path to the landing site, real-time airport traffic information, and the like.

The routing tool 1100 also can include a performance learning system 1132 (PLS). The PLS 1132 also may include a processor (not illustrated) for executing software to provide the functionality of the PLS 1132. In operation, the processor uses aircraft-performance algorithms to generate an aircraft performance model 1134 from flight maneuvers. In some embodiments, the PLS 1132 is configured to execute a model generation cycle during which the performance model 1134 is determined and stored. The model generation cycle can begin with execution of one or more maneuvers, during which data from one or more sensors on or in communication with the aircraft can be recorded. The recorded data may be evaluated to generate the aircraft performance model 1134, which can then represent, for example, glide paths of the aircraft under particular circumstances, fuel consumption during maneuvers, change in speed or altitude during maneuvers, other performance characteristics, combinations thereof, and the like. In some embodiments, the performance model 1134 is continually or periodically updated. As will be explained in more detail below, the performance model 1134 may be used to allow a more accurate evaluation of landing sites as the evaluation can be based upon actual aircraft performance data, as opposed to assumptions based upon current operating parameters and the like.

During operation of the aircraft, data retrieved from the databases 1104, data retrieved from the real-time data sources 1122, and/or the aircraft performance model 1134 can be used by the routing tool 1100 to provide multiple layers of data on an in-flight display 1136 of the aircraft. In-flight display 1136 may be an example of one implementation of display system 212 in FIG. 2. The in-flight display 1136 may include any suitable display of the aircraft such as, for example, a display of the EFB, an NAY, a primary flight display (PFD), a heads up display (HUD), or a multifunction display unit (MDU), an in-flight display 1136 for use by aircraft personnel.

Figure 12A:
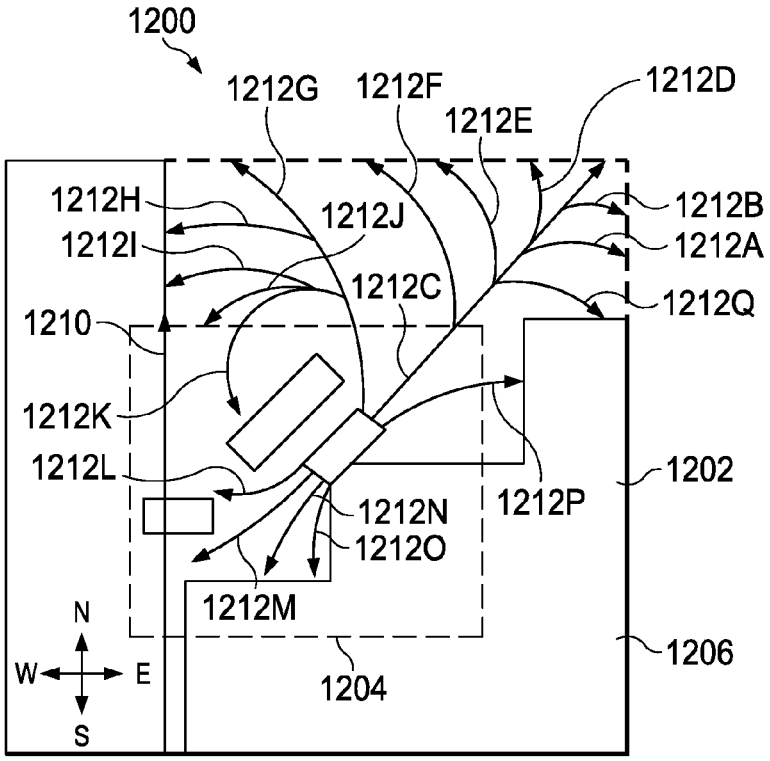
FIGS. 12A-12B are illustrations of additional details of a routing tool in accordance with an illustrative embodiment.

Additionally, or alternatively, the data can be passed to the routing module 1102 and/or to off-board personnel and systems, to identify safe landing sites, to analyze the safe landing sites, and to select a landing site and a flight path to the safe landing sites. In some embodiments, the landing site and flight path information can be passed to the in-flight display 1136 or another display. As will be described below, the in-flight display 1136 or another display can provide a moving map display for mapping the landing sites and flight paths thereto, displaying glide profile views, weather, obstructions, time remaining to follow a desired flight path, and/or other data to allow determinations to be made by aircraft personnel. Additionally, as mentioned above, the data can be transmitted to off-board personnel and/or systems. Turning now to FIG. 12A, additional details of the routing tool 1100 are provided, according to an illustrative embodiment. FIG. 12A illustrates an exemplary landing site display 1200, which can be generated by the routing tool 1100. Landing site display 1200 may be an example of one implementation for information displayed on display system 212 in FIG. 2.

In these illustrative examples, the landing site display 1200 includes a landing site 1202, and an area surrounding the landing site 1202.

In these depicted examples, the size of the landing site display 1200 can be adjusted based upon data included in the display 1200 and/or preferences. The landing site 1202 can include an airport runway, a field, a highway, and/or another suitable airport or off-airport site. In the illustrated embodiment, the landing site 1202 is illustrated within a landing zone grid 1204, which graphically represents the distance needed on the ground to safely land the aircraft.

The illustrated landing site 1202 is bordered on at least three sides with obstructions that prevent a safe ingress by the aircraft. In particular, an area of tall vegetation 1206, e.g., trees, borders the landing site 1202 on the south and east sides, preventing the aircraft from approaching the landing site 1202 from the south or east. Additionally, buildings 1208 and power lines 1210 border the landing site 1202 along the west side and northwest sides. These manmade and naturally occurring features limit the possible approach paths for the aircraft. As illustrated, a spanning tree showing allowed ingress flight paths 1212A-Q is shown. In the illustrated embodiment, the aircraft can land at the landing site 1202 only by approaching via flight paths 1212A-G, while flight paths 1212H-Q are obstructed. The generation and use of spanning trees such as the spanning tree illustrated in FIG. 12A will be described in more detail below.

Figure 12B:
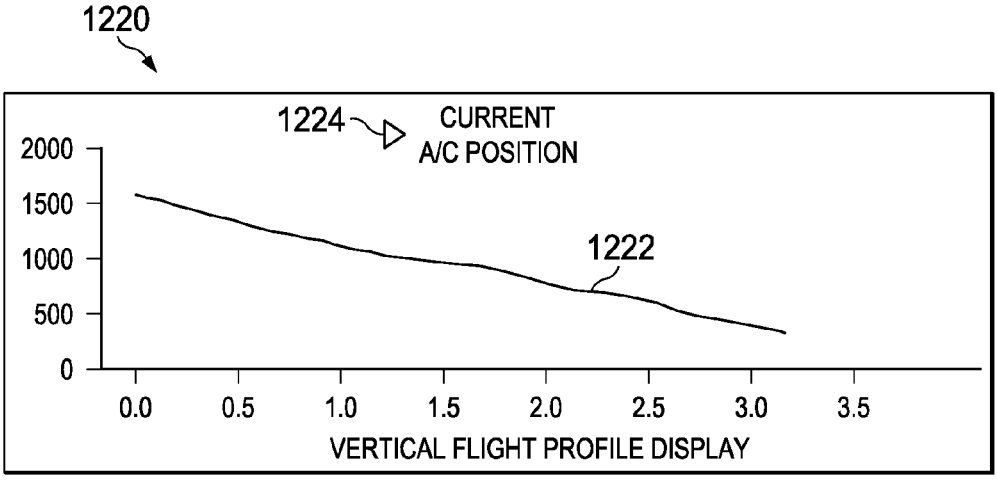

FIG. 12B illustrates an exemplary glide profile view display 1220, according to an exemplary embodiment. In some embodiments, the glide profile view display 1220 is generated by the routing tool 1100 and displayed with the landing site display 1200 on in-flight display 1136 in FIG. 11 to indicate a glide path 1222 required to be met or exceeded by an aircraft in order to successfully and safely land at the landing site 1202. The glide path 1222 is plotted as an altitude versus horizontal distance traveled along the path. The glide profile view display 1220 includes an indication of the current aircraft position. As illustrated in FIG. 12B, the aircraft currently has more than sufficient altitude to reach the landing site 1202. In fact, in the illustrated embodiment, the aircraft is illustrated as being about nine hundred feet above the minimum altitude glide profile. Thus, the pilot of the aircraft will need to descend relatively quickly to successfully execute the landing. This example is illustrative, and is provided for purposes of illustrating the concepts disclosed herein.

Figure 13A:
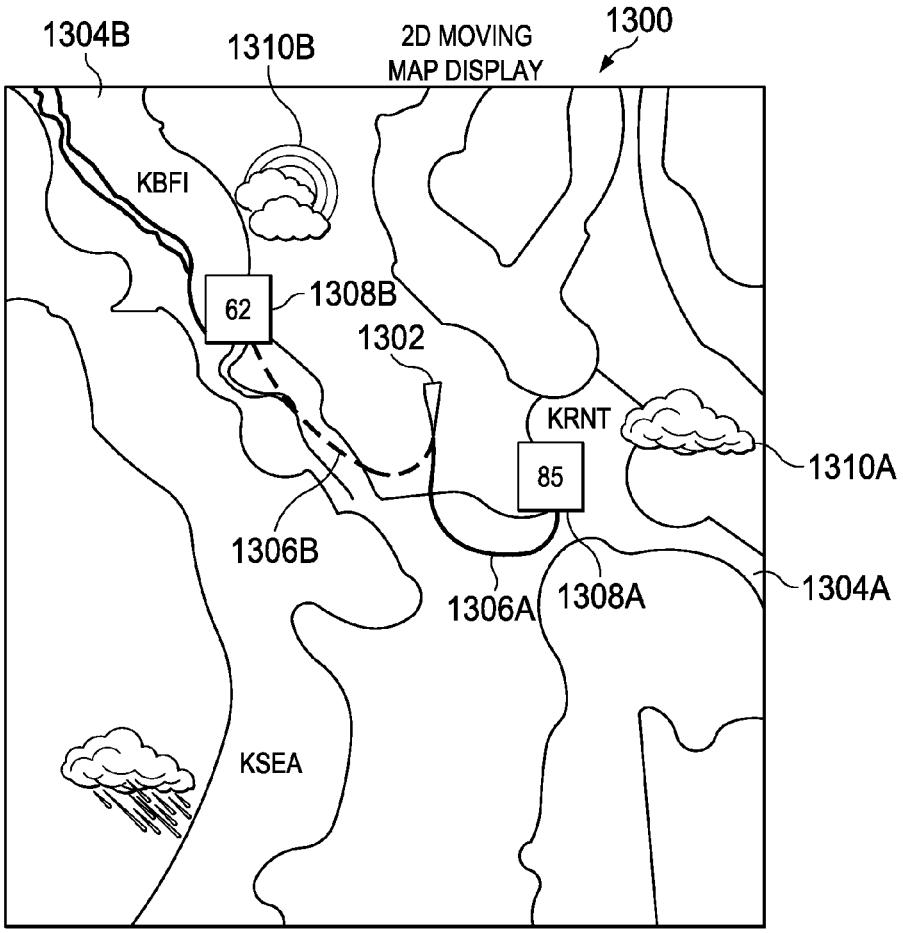
FIGS. 13A-13B are illustrations of exemplary screen displays in accordance with illustrative embodiments.
Figure 13B:
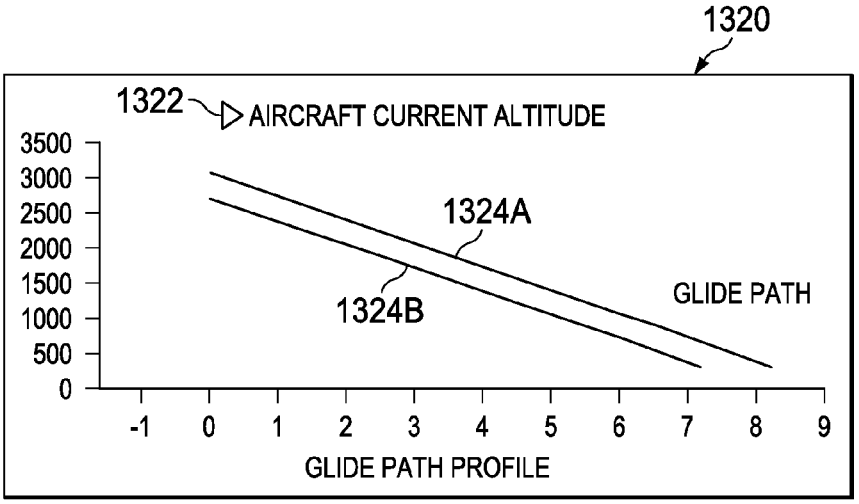

Turning now to FIGS. 13A-13B, exemplary screen displays are illustrated according to illustrative embodiments. In particular, FIG. 13A illustrates a moving map display 1300 for an exemplary embodiment of the moving map display. The moving map display 1300 can be displayed on the in-flight display 1136, a computer display of an onboard computer system, a display of an off-board computer system, or another display. The moving map display 1300 illustrates a current position 1302 of an aircraft that is about to make an unplanned landing, e.g., an emergency landing. Current position 1302 includes current location 202 in FIG. 2 and may include other parameters such as the orientation of the aircraft in space. The routing tool 1100 identifies two candidate landing sites 1304A, 1304B. In this illustrative example, candidate landing site 1304 and candidate landing site 1304B are examples of landing sites that may be in group of landing sites 114 in FIG. 1. Additionally, the routing tool 1100 determines, based upon any of the data described above, ingress paths 1306A, 1306B for the landing sites 1304A-B. In the illustrated embodiment, the ingress path 1306A is a preferred ingress path as it leads to the preferred landing site 1304A, and the ingress path 1306B is a secondary ingress path as it leads to the secondary landing site 1304B. This embodiment is exemplary.

The ingress paths 1306A-B take into account any of the data described herein including, but not limited to, the data stored at the database 1104. Additionally, the routing tool 1100 is configured to access the real-time data sources 1122, and can display time indications 1308A, 1308B, which indicate a time remaining by which the aircraft must commit to the respective ingress path 1306A, 1306B in order to safely follow the proposed route. In FIG. 13A, the time indications 1308A, 1308B are displayed as numbers over respective landing sites. In the illustrated embodiment, the numbers correspond to numbers of seconds remaining for the aircraft to commit to the associated landing sites 1304A, 1304B and ingress paths 1306A, 1306B and still make a safe landing. Thus, the numbers represent a number of seconds left before the ingress paths 1306A-B are invalid, assuming the aircraft remains on a course substantially equivalent to its current course. In FIG. 13A, the recommended route 1306A remains available for 85 seconds, while the second route 1306B remains available for 62 seconds, i.e., 23 seconds less than the recommended route 1306A.

Additionally displayed on the moving map display 1300 are weather indications 1310A, 1310B, corresponding to weather at the landing sites 1304A, 1304B, respectively. The weather indications 1310A-B correspond to overcast skies at the landing site 1304A, and clear skies at the landing site 1304B. These indications are exemplary, and should not be construed as being limiting in any way. The weather at prospective landing sites 1304A-B may be important information, as good visibility is often vital in an emergency landing situation. Similarly, certain weather conditions such as high winds, turbulence, thunderstorms, hail, and the like can put additional stress on the aircraft and/or the pilot, thereby complicating landing of what may be an already crippled aircraft.

Turning now to FIG. 13B, a glide profile view display 1320 is illustrated, according to an illustrative embodiment. As explained above with reference to FIG. 12B, the routing tool 1100 can be configured to provide the glide profile view display 1320 with the moving map display 1300 to provide aircraft or other personnel with a better understanding of the available options. The glide profile view display 1320 includes a current aircraft position indicator 1322. Also illustrated on the glide profile view display 1320 are representations 1324A, 1324B of glide paths needed to successfully ingress to the landing sites 1304A, 1304B of FIG. 13A. The representations 1324A, 1324B ("glide paths") correspond, respectively, to the ingress paths 1306A, 1306B of FIG. 13A, and show the altitude needed to arrive safely at the landing sites 1304A, 1304B, respectively. As shown in FIG. 13B, the aircraft currently has sufficient altitude to approach both landing sites 1304A-B.

The glide profile view display 1320 allows the pilot to instantaneously visualize where the aircraft is with respect to the available landing sites 1304A-B and/or ingress paths 1306A-B in the vertical (altitude) plane. Thus, the routing module 1102 allows the pilot to more quickly evaluate the potential landing sites 1306A-B by continuously displaying the aircraft's vertical position above or below the approach path to each site. This allows at-a-glance analysis of landing site feasibility and relative merit.

The glide profile view display 1320 can be an active or dynamic display. For example, the glide profile view display 1320 can be frequently updated, for example, every second, 5 seconds, 10 seconds, 1 minute, 5 minutes, or the like. Potential landing sites 1304A-B that are available given the aircraft's position and altitude can be added to and/or removed from the glide profile view display 1320 as the aircraft proceeds along its flight path. Thus, if an emergency situation or other need to land arises, the pilot can evaluate nearby landing sites 1306A-B and choose from the currently available glide paths 1324A-B, which are continuously calculated and updated. In some embodiments, the descent glide 1324A-B are updated and/or calculated from a database loaded during a flight planning exercise.

The aircraft's current flight path can be connected to the best available ingress path 1306A-B by propagating the aircraft to align in position and heading to the best ingress path 1306A or 1306B. In the illustrated embodiment, the secondary or alternate route 1306B requires more energy than the energy required for the preferred route 1306A. In the case of an aircraft that is gliding dead stick, the alternate route 1306B requires that the aircraft must start at a higher altitude than the altitude required for aircraft to glide along the preferred route 1306A.

Figure 14:
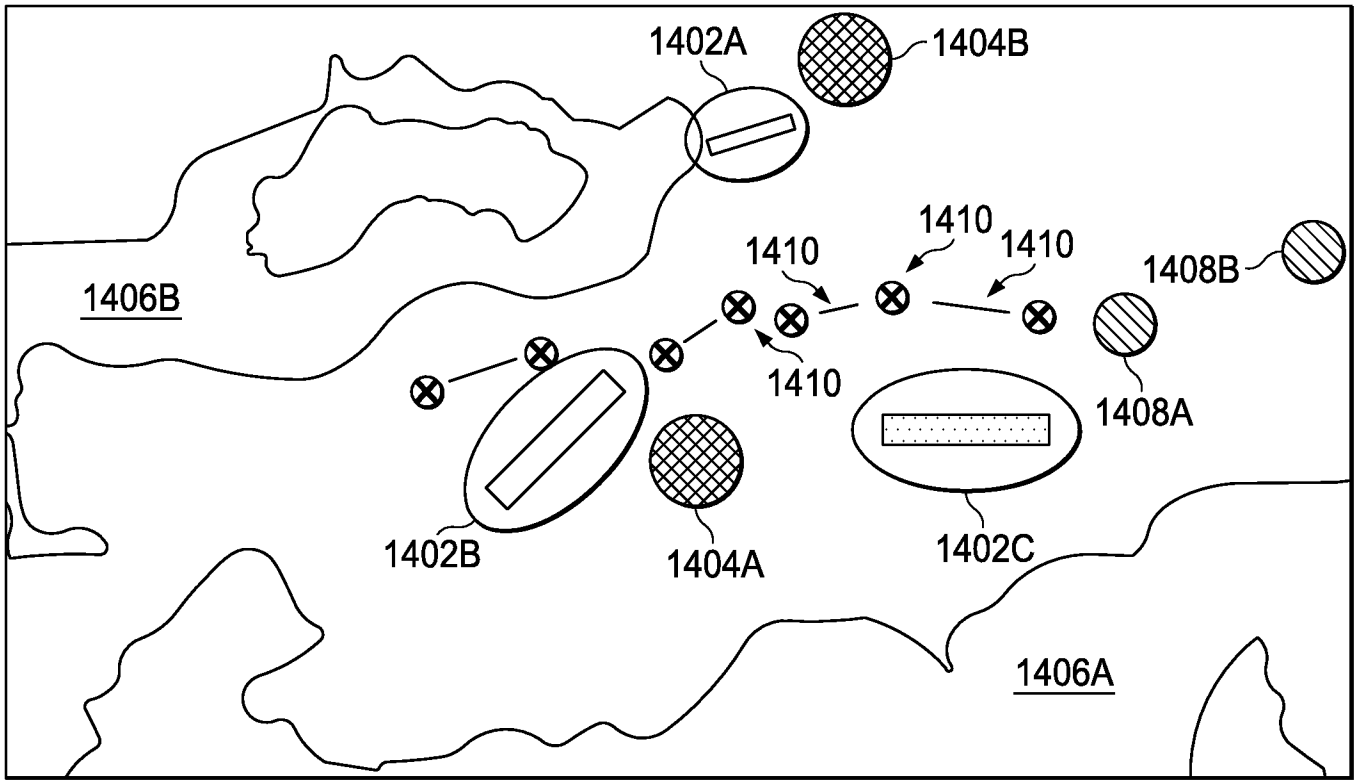
FIG. 14 is an illustration of additional details of the routing tool illustrated in accordance with an illustrative embodiment.

Turning now to FIG. 14, additional details of the routing tool are illustrated, according to an illustrative embodiment. FIG. 14 shows map display 1400 generated by the routing tool 1100, according to an exemplary embodiment. The map display 1400 includes three possible landing sites 1402A, 1402B, 1402C that may be chosen during an emergency situation, such as, for example, an in-flight fire, an engine failure or "engine out" event, a critical systems failure, a medical emergency, a hijacking, or any other situation in which an expeditious landing is warranted.

The map display 1400 graphically illustrates obstructions and features that may be important when considering an emergency landing at a potential landing site 1402A-C. The illustrated map display 1400 shows golf courses 1404A, 1404B, bodies of water 1406A, 1406B, fields 1408A, 1408B, and other obstructions 1410 such as power lines, bridges, ferry routes, buildings, towers, population centers, and the like. In the illustrated embodiment, the potential landing sites 1402A-C are airports. As is generally known, a landing zone for an airport has constraints on how and where touchdown can occur. In particular, if an aircraft needs a distance D after touchdown to come to a complete stop, the aircraft needs to touch down at a point on the runway, and heading in a direction along the runway, such that there is at least the distance between the touchdown point and the end of the runway or another obstruction. Therefore, a pilot or other aircraft personnel may need this information to arrive at the landing site 1402A-C in a configuration that makes a safe landing possible. Typically, however, the pilot or other aircraft personnel do not have time during an emergency situation to determine this information. Additionally, the level of detail needed to determine this information may not be available from a typical aviation map.

Figure 15A:
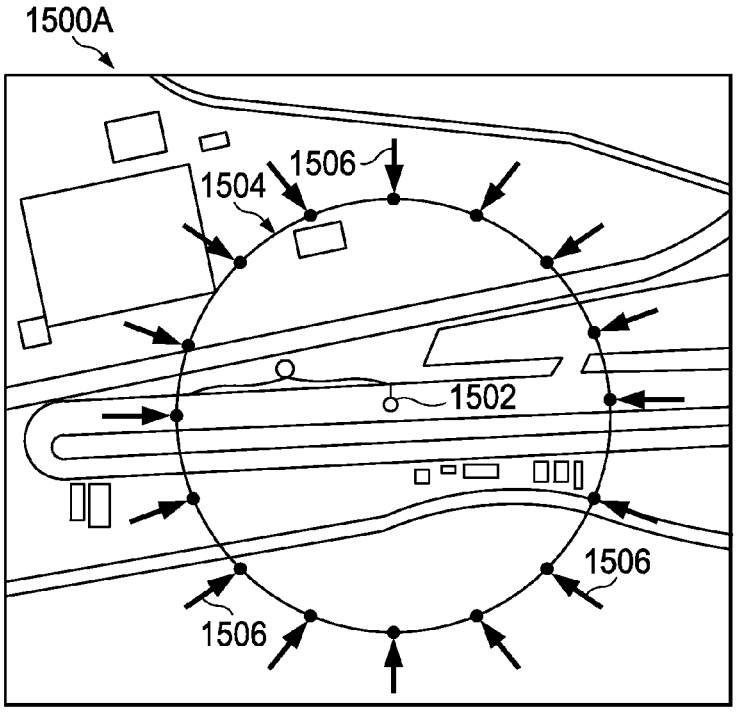
FIGS. 15A-15B are illustrations of a landing site map in accordance with an illustrative embodiment.
Figure 15B:
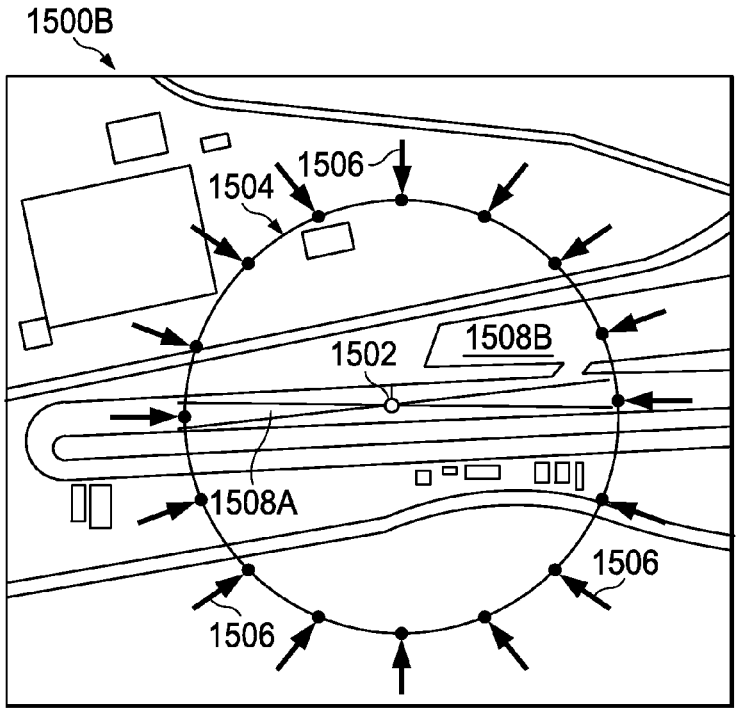

FIGS. 15A-15B illustrate this problem. FIG. 15A illustrates a landing site map 1500A, according to an illustrative embodiment. The landing site map 1500A includes a touchdown point 1502. The touchdown point 1502 is surrounded by a circle 1504 with a radius (D). The radius corresponds to the distance needed from touchdown to bring the aircraft to a complete stop, and therefore represents a distance needed from the touchdown point 1502 to a stopping point to safely land the aircraft. Thus, the circle 1504 illustrates the possible points at which the aircraft could stop if the aircraft lands at the touchdown point 1502. As can be seen in FIG. 15A, only a small number of headings 1506 are safe to execute a landing at the touchdown point 1502.

Turning now to FIG. 15B, another landing site map 1500B is illustrated, according to an exemplary embodiment. FIG. 15B illustrates two subarcs 1508A, 1508B, corresponding to headings 1508 along the circle 1504 at which the aircraft can land safely at the illustrated touchdown point 1502. The illustrated subarcs 1508A-B and circle 1504 are exemplary. In accordance with concepts and technologies described herein, the orientation of the subarcs 1508A-B are determined and stored at the routing tool 1100, for example, during flight planning or during ingress to the landing site during an emergency condition.

The routing module 1102 is configured to determine the subarcs 1508A-B by beginning at the touchdown point 1502 and working backwards toward the current location. Based upon a knowledge of constraints on the landing area, such as, terrain, obstacles, power lines, buildings, vegetation, and the like, the routing module 1102 limits the touchdown points to the subarcs 1508A-B. The routing module 1102 determines these subarcs 1508A-B based upon the known aircraft performance model 1134 and/or knowledge of parameters relating to aircraft performance in engine-out conditions. In particular, the routing module 1102 executes a function based upon the zero-lift drag coefficient and the induced drag coefficient. With knowledge of these coefficients, the weight of the aircraft, and the present altitude, the routing module 1102 can determine a speed at which the aircraft should be flown during ingress to the landing site and/or the touchdown point 1502.

Additionally, the routing module 1102 determines how the aircraft needs to turn to arrive at the landing site with the correct heading for a safe landing. The routing module 1102 is configured to use standard rate turns of three-degrees per second to determine how to turn the aircraft and to verify that the aircraft can arrive safely at the landing site with the correct heading, speed, and within a time constraint. It should be understood that any turn rate including variable rates can be used, and that the performance model 1134 can be used to tailor these calculations to known values for the aircraft. The routing module 1102 outputs bank angle, which is displayed in the cockpit, to instruct the pilot as to how to execute turns to arrive at the landing site safely. In practice, the aircraft flies along the ingress path at the maximum lift over drag (LID) ratio. Meanwhile, the routing module 1102 supplies the pilot with the bank angle required to approach the landing site along the correct heading for the known subarcs 1508A-B. The bank angles are displayed in the cockpit so the pilot can accurately fly to the landing site without overshooting or undershooting the ideal flight path.

Figure 16A:
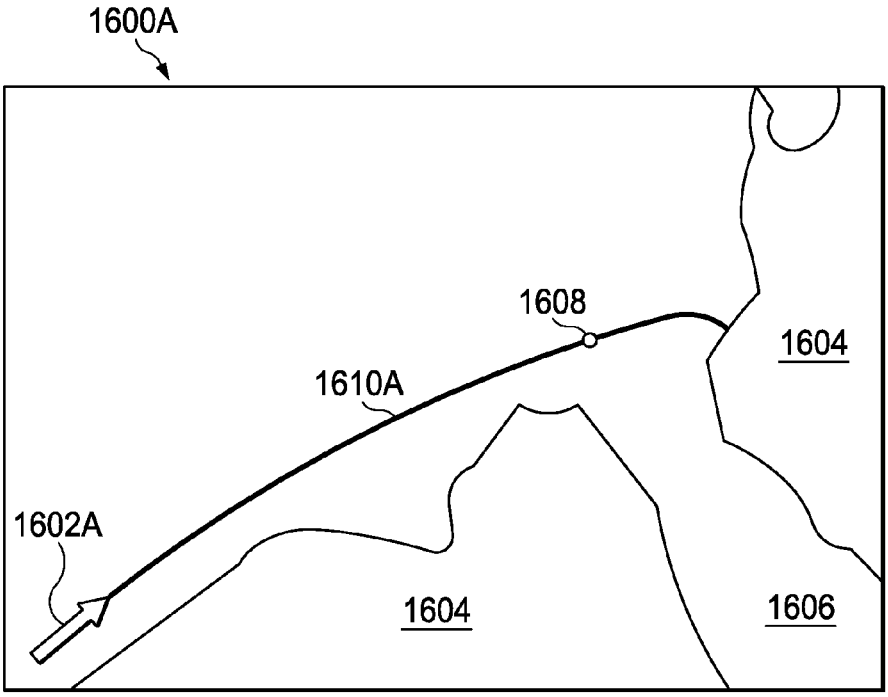
FIGS. 16A-16B are illustrations of flight path planning methods in accordance with illustrative embodiments.
Figure 16B:
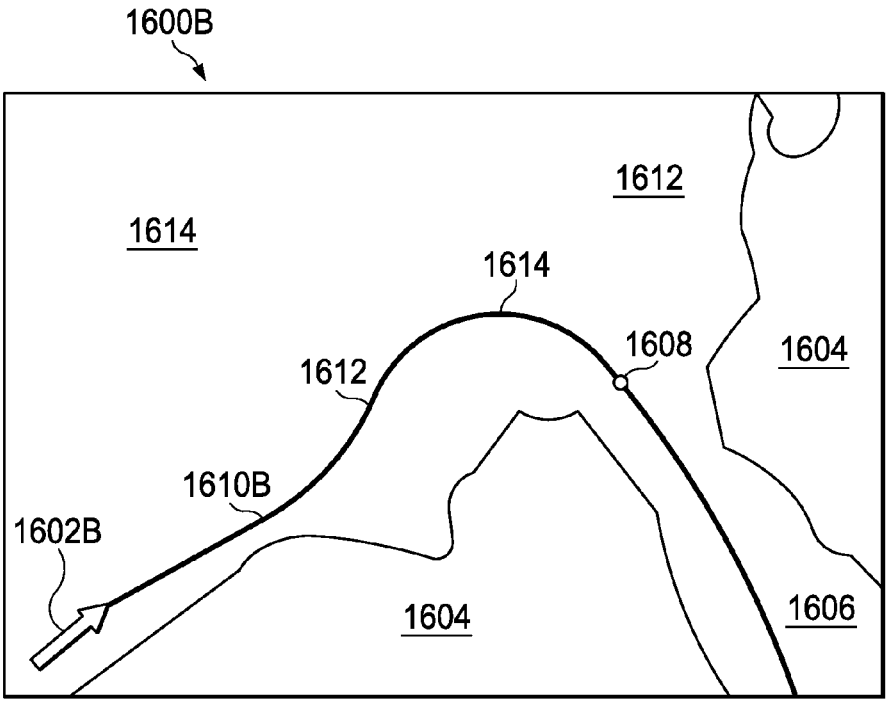

Turning now to FIGS. 16A-16B, the logic employed by the routing module 1102 will be described in more detail. Some routing algorithms build spanning trees rooted at the origin of the path. Locations in space are added to the spanning tree when the algorithm knows the minimal cost route to that point in space. Most applications of the algorithm stop when a destination is added to the spanning tree. The routing module 1102 of the routing tool 1100, on the other hand, is configured to build spanning trees that are rooted at one or more touchdown points 1502. The spanning trees grow from the touchdown points 1502 outward. An example of such a spanning tree is illustrated above in FIG. 12A. In building the spanning trees, the routing module 1102 minimizes altitude changes while moving away from the touchdown point 1502.

Once the spanning tree is built, the routing tool 1100 or the routing module 1102 can query the spanning tree from any location and know what minimum altitude is needed to reach the associated touchdown point 1502 from that location. Additionally, by following a branch of the spanning tree, the routing module 1102 instantly ascertains the route that will minimize altitude loss during ingress to the landing site.

In some embodiments of the routing tool 1100 and/or the routing module 1102 disclosed herein, the spanning trees for each landing site along a flight path may be generated in real-time, and can be pre-calculated during a flight planning stage and/or computed in real-time or near-real-time during an emergency situation. With the spanning tree, the routing module 1102 can determine the minimal cost path to the origin, wherein cost may be a function of time, energy, and/or fuel.

FIGS. 16A-16B schematically illustrate flight path planning methods, according to illustrative embodiments. Referring first to FIG. 16A, a map 1600A schematically illustrates a first method for planning a flight path. On the map 1600A, an ownship indicator 1602A shows the current position and heading of an aircraft. The map 1600A also indicates terrain 1604 that is too high for the aircraft to fly over in the illustrated embodiment. For purposes of illustration, it is assumed herein that the aircraft needs to turn into the canyon 1606, the beginning of which is represented by the indication 1608. Using a standard path planning algorithm, a flight path 1610A is generated from the current position and heading 1602A. The algorithm essentially searches for the minimal cost route to the entrance point indicated by the indication 1608. The algorithm will seek to extend the route for the aircraft from that location. Unfortunately, from the entrance point indicated by the indication 1608, the aircraft will not be able to complete the turn without hitting the terrain 1604.

Turning now to FIG. 16B, a map 1600B schematically illustrates a second method for planning a flight path. More particularly, the map 1600B schematically illustrates a method used by the routing module 1102, according to an exemplary embodiment. The algorithm used in FIG. 16B begins at the entrance point indicated by the indication 1608, and works back to the current position and heading indicated by the ownship indicator 1602B. Thus, the algorithm determines that in order to enter the canyon 1606, the aircraft must fly along the flight path 1610B. In particular, the aircraft must first incur cost making a left turn 1612, and then make a long costly right turn 1614 to line up with the canyon 1606. It should be understood that the scenarios illustrated in FIGS. 16A-16B are exemplary.

Figure 17A:
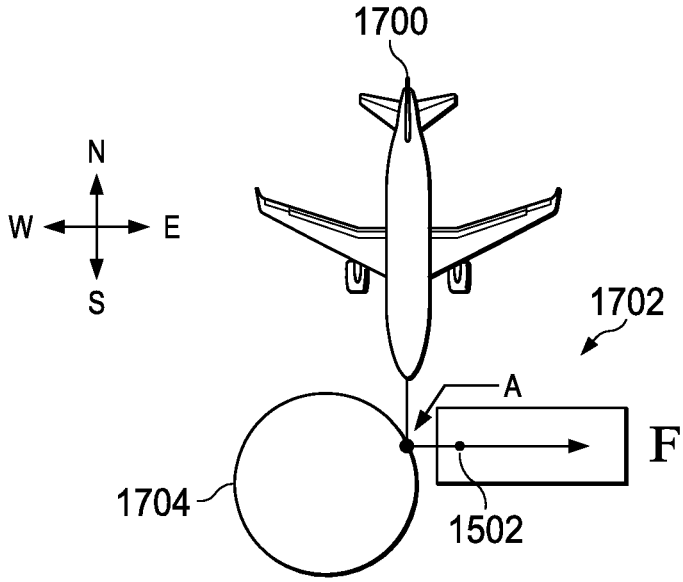
FIGS. 17A-17B are illustrations of additional details of the routing tool in accordance with an illustrative embodiment.
Figure 17B:
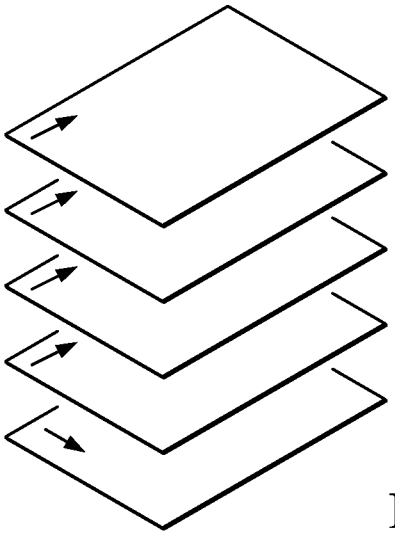

Turning now to FIG. 17A, additional details of the routing tool 1100 are described in more detail. In FIG. 17A, an aircraft 1700 is flying south and is attempting to land on an east-west landing zone 1702. The proximity of the aircraft 1700 to the landing zone 1702 makes a safe ingress by way of a direct 90° turn at point A unsafe and/or impossible. In accordance with the concepts and technologies disclosed herein, the routing module 1102 begins at the landing zone 1702 and works back to the aircraft 1700. In so doing, the routing module could determine in the illustrated embodiment that the aircraft 1700 must make a 270° turn beginning at point A and continuing along the flight path 1704 to arrive at the landing zone 1702 in the correct orientation. Thus, the aircraft 1700 could cross point A twice during the approach, though this is exemplary. As is generally known, standard path planning algorithms are designed to accommodate only one path, and a path that traverses any particular point in space only once. Thus, the flight path 1704 would not be generated using a standard path planning algorithm.

According to exemplary embodiments, the routing module 1102 includes path planning functionality that adds an angular dimension to the space. Therefore, instead of searching over a two-dimensional space, the algorithm works in three dimensions, wherein the third dimension is aircraft heading. For the flight path 1704 illustrated in FIG. 17A, the flight paths 1704 can cross over themselves as long as the multiple routes over a point are at different headings. The functionality of the three dimensional approach is illustrated generally in FIG. 17B.

Figure 18:
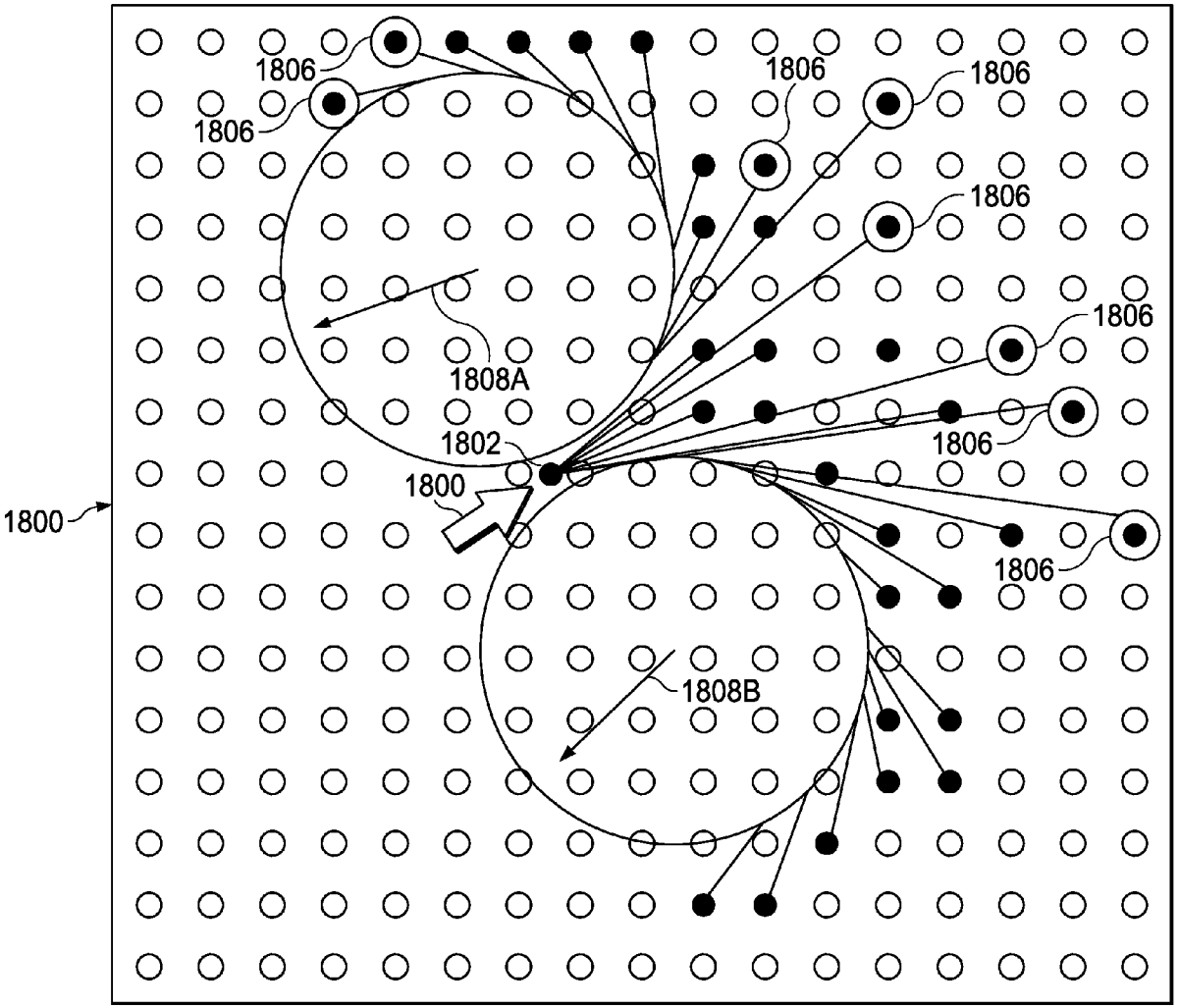
FIG. 18 is an illustration of additional details of the routing tool in accordance with an illustrative embodiment.

Turning now to FIG. 18, additional details of the routing tool 1100 are described in detail. FIG. 18 generally illustrates the application of turn constraints in an update phase of the path planning algorithm. When a point in space is added to the spanning tree, the algorithm attempts to extend the path to neighboring points in the space. For turn constrained situations, the reachable neighbors are constrained as shown in FIG. 18. A current position and heading 1800 of an aircraft at a point 1802 that was just added to the spanning tree is illustrated in FIG. 18. The points 1806 represent neighboring points that the algorithm will attempt to reach when extending the path.

The turn constraints are not limited to any particular turn radius. The turn radius 1808A can be different than the turn radius 1808B. The algorithm can try different turn radii in an attempt to minimize altitude loss. For example, if the aircraft is trying to reach a point behind its current position. It could use a controlled turn that has less altitude loss per degree of turn. It could also make a tighter turn with more altitude loss per degree of turn. The longer distance of the controlled turn could result in more total altitude loss than the shorter tighter turn. If the tighter turn produces less total altitude loss, the algorithm will use the tighter turn.

While relatively computationally expensive, generation of the spanning trees can be performed pre-departure. A database of spanning trees rooted at various landing locations and under various conditions can be loaded into the aircraft for use during flight. At any point during the flight the current aircraft position and heading can be compared with spanning trees rooted in the local area. Because the altitude for points along the spanning tree are pre-calculated in the spanning tree, the routing tool 1100 can instantly know at what altitude the aircraft needs to be in order to make it to the given landing location. It also will instantly know the path to take for minimal altitude loss.

If the aircraft is higher than the maximum altitude of the spanning tree, the on-board computer needs to connect up the aircraft's current location and heading with the spanning tree. Starting with the point on the spanning tree that is nearest the aircraft position, the routing module 1102 searches the points in the spanning tree to find the first point that is still feasible after considering the altitude losses incurred flying to that point and an associated heading. Computationally, this only involves a simple spatial sort and a two turn calculation.

Figure 19:
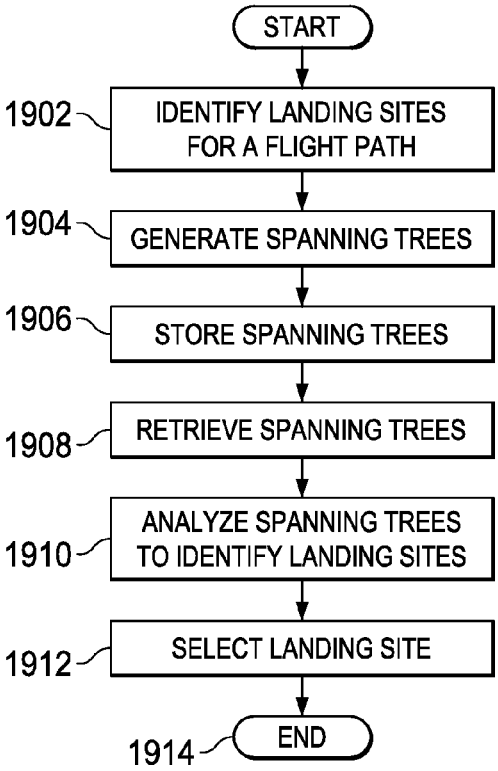
FIG. 19 is an illustration of a routine for determining landing sites for an aircraft in accordance with an illustrative embodiment.

Turning now to FIG. 19, additional details will be provided regarding embodiments presented herein for determining landing sites for aircraft. It should be appreciated that the logical operations described herein are implemented (1) as a sequence of computer implemented acts or program modules running on a computing system and/or (2) as interconnected machine logic circuits or circuit modules within the computing system. The implementation is a matter of choice dependent on the performance and other operating parameters of the computing system. Accordingly, the logical operations described herein are referred to variously as operations, structural devices, acts, or modules. These operations, structural devices, acts, and modules may be implemented in software, in firmware, hardware, in special purpose digital logic, and any combination thereof. It should also be appreciated that more or fewer operations may be performed than shown in the figures and described herein. These operations may also be performed in parallel, or in a different order than those described herein.

FIG. 19 shows a routine 1900 for determining landing sites for an aircraft, according to an illustrative embodiment. In one embodiment, the routine 1900 is performed by the routing module 1102 described above with reference to FIG. 11. It should be understood that this embodiment is exemplary, and that the routine 1900 may be performed by another module or component of an avionics system of the aircraft; by an off-board system, module, and/or component; and/or by combinations of onboard and off-board modules, systems, and components. The routine 1900 begins at operation 1902, wherein flight data is received. The flight data can include flight plans indicating a path for a planned flight. The flight path can be analyzed by the routing module 1102 to identify landing sites such as airports, and alternative landing sites such as fields, golf courses, roadways, and the like. The routing module 1102 can access one or more of the databases 1104 to search for, recognize, and identify possible alternative landing sites for the anticipated flight path.

The routine 1900 proceeds from operation 1902 to operation 1904, wherein spanning trees can be generated for each identified landing site and/or alternative landing site. As explained above, the spanning trees can be generated from the landing sites, back into the airspace along which the flight path travels. In some embodiments, a spanning tree is generated for each landing site along the flight path or within a specified range of the flight path. The specified range may be determined based upon intended cruising altitude and/or speed, and therefore the anticipated glide profile that the aircraft may have in the event of an emergency condition. It should be understood that this embodiment is exemplary, and that other factors may be used to determine the landing sites for which spanning trees should be generated.

The routine 1900 proceeds from operation 1904 to operation 1906, wherein the generated spanning trees are loaded into a data storage location. The data storage location can be onboard the aircraft, or at the ATC, ARTCC, AOC, or another location. At some point in time, the aircraft begins the flight. The routine 1900 proceeds from operation 1906 to operation 1908, wherein in response to an emergency condition, the spanning databases are retrieved from the data storage device.

The routine 1900 proceeds from operation 1908 to operation 1910, wherein the spanning trees are analyzed to identify one or more attainable landing sites, and to prompt retrieval of landing site information such as distance from a current position, weather at the landing sites, a time in which the route to the landing site may be selected, and the like. The routine 1900 proceeds from operation 1910 to operation 1912, wherein the information indicating the landing sites and information relating to the landing sites such as distance from a current location, weather at the landing sites, a time in which the route to the landing site must be selected, and the like, are displayed for aircraft personnel. In addition to displaying a moving map display with the attainable landing sites and information relating to those landing sites, the routing tool 1100 can obtain additional real-time data such as, for example, weather data between the current position and the landing sites, traffic data at or near the landing sites, and the like, and can display these data to the aircraft personnel.

The routine 1900 proceeds from operation 1910 to operation 1912, wherein a landing site is selected, and the aircraft begins flying to the selected landing site. In selecting the landing site, the weather conditions at the landing site, near the landing site, or on a path to the landing site may be considered as visibility can be a vital component of a successful and safe ingress to a landing site. The routine 1900 proceeds to operation 1914, whereat the routine 1900 ends.

Figure 20:
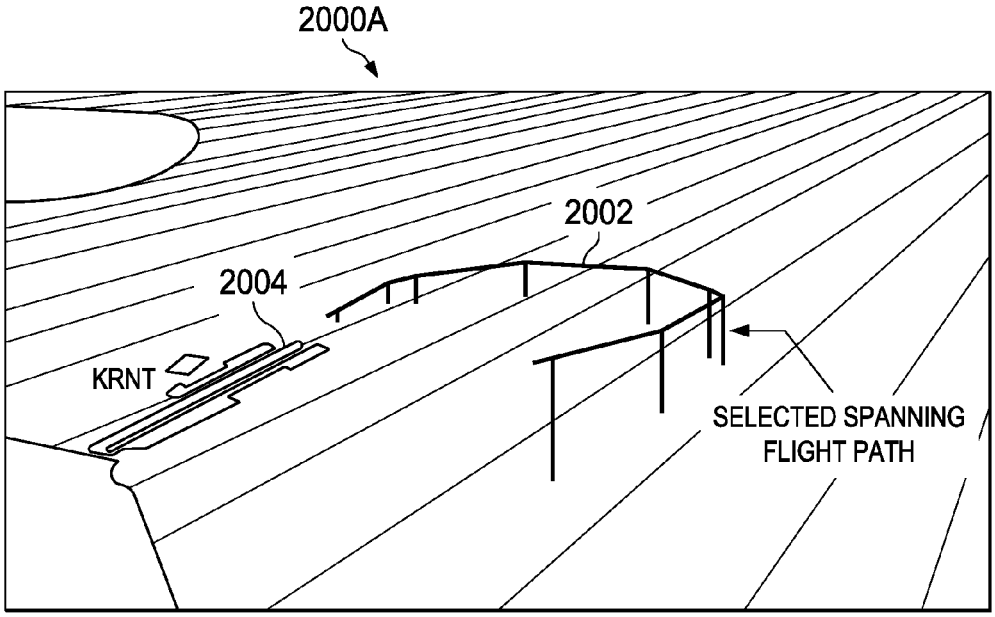
FIGS. 20-21 are illustrations of screen displays provided by a graphical user interface (GUI) for the routing tool in accordance with illustrative embodiments.
Figure 21:
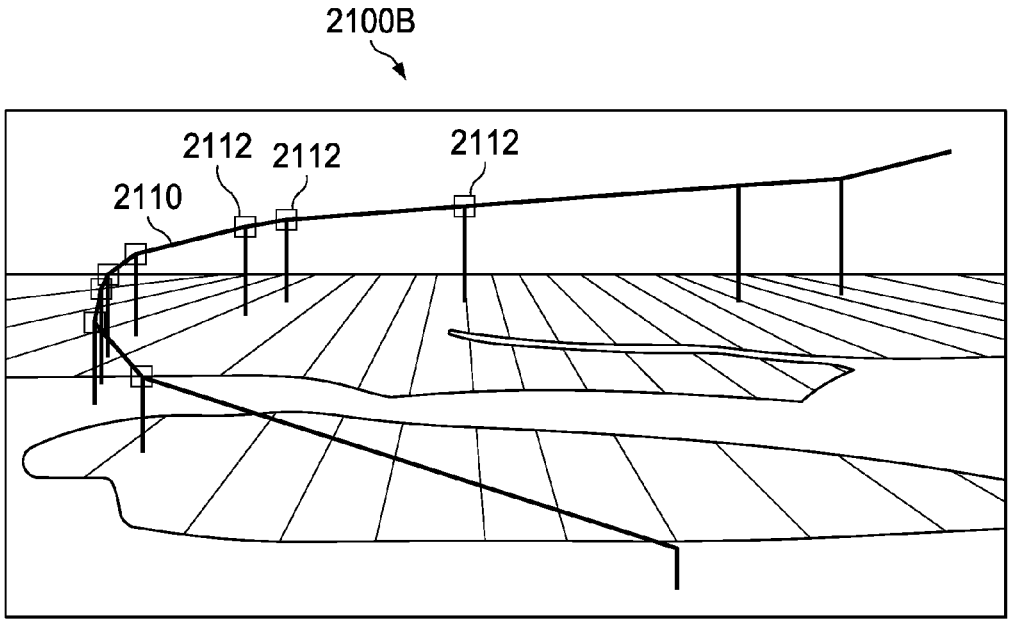

Referring now to FIGS. 20-21, screen displays 2000A, 2100B provided by a graphical user interface (GUI) for the routing tool 1100 are illustrated, according to illustrative embodiments. The graphical user interface displaying screen display 2000A and screen display 2100B may be display system 212 in FIG. 2. Screen display 2000A and screen display 2100B can be displayed on the pilot's primary flight display (PFD), if the aircraft is so equipped, or upon other displays and/or display devices, if desired. FIG. 20 illustrates a three-dimensional screen display 2000A provided by the routing tool 1100, according to an illustrative embodiment.

The line 2002 represents a flight path required to safely ingress into the landing site, and to touchdown at the touchdown point 2004. The view of FIG. 20 is shown from the perspective of the cockpit. From the illustrated perspective, it is evident that the aircraft currently is above the minimum altitude required for a safe landing, as indicated by the line 2002. Therefore, the aircraft has sufficient energy to reach the touchdown point 2004.

FIG. 21 illustrates another three-dimensional screen display 2100B provided by the routing tool 1100, according to another illustrative embodiment. In particular, FIG. 21 illustrates a flight path 2110 for ingress to a landing site. The flight path includes targets 2112. During an approach, the pilot attempts to pass the aircraft through the targets 2112. Upon passing through all of the targets 2112, the aircraft is in position to land at the landing site. Thus, the GUI provided by the routing tool 1100 can be configured to provide guidance for a pilot to navigate an aircraft to a landing site in an emergency. These embodiments are exemplary, and should not be construed as being limiting in any way.

According to various embodiments, the routing tool 1100 interfaces with an ATC, ARTCC, or AOC to exchange information on potential landing sites as the flight progresses, or for allowing the ATC or AOC to monitor or control an aircraft in distress, or to potentially reroute other aircraft in the area to enhance ingress safety. According to other embodiments, the routing tool 1100 is configured to report aircraft status according to a predetermined schedule or upon occurrence of trigger events such as, for example, sudden changes in altitude, disengaging an autopilot functionality, arriving within 100 miles or another distance of an intended landing site, or other events. According to yet other embodiments, the routing tool 1100 determines, in real-time, potential landing sites with the assistance of an off-board computer system such as, for example, a system associated with an ATC, ARTCC, or AOC. The routing module can transmit or receive the information over the current flight operations bulletin (FOB) messaging system, or another system.

The ATC, ARTCC, and/or AOC have the capability to uplink information on potential emergency landing sites as the aircraft progresses on its flight path. For example, the ATC, ARTCC, and/or AOC can use data in the databases 1104 and data from the real-time data sources 1122 to determine a landing site for the aircraft. Information relating to the landing sites may be uplinked by any number of uplink means to the aircraft. The ATC, ARTCC, and/or AOC broadcast the information at regular intervals, when an emergency is reported, and/or when a request from authorized aircraft personnel is originated.

In another embodiment the aircraft broadcasts potential landing sites to the ATC, ARTCC, or AOC as the aircraft progresses on its flight. Alternatively, the aircraft broadcasts only when there is an emergency or when a request for information is made from the ATC, ARTCC, or AOC. Thus, the ATC, ARTCC, or AOC can identify, in real-time or near-real-time, the chosen landing site of an aircraft posting an emergency. If appropriate, other traffic may be re-routed to ensure a safe ingress to the chosen landing site. It should be understood that the aircraft and the ATC, ARTCC, or AOC can have continuous, autonomous, and instantaneous information on the choices of landing sites, thereby adding an extra layer of safety to the routing tool 1100.

Figure 22:
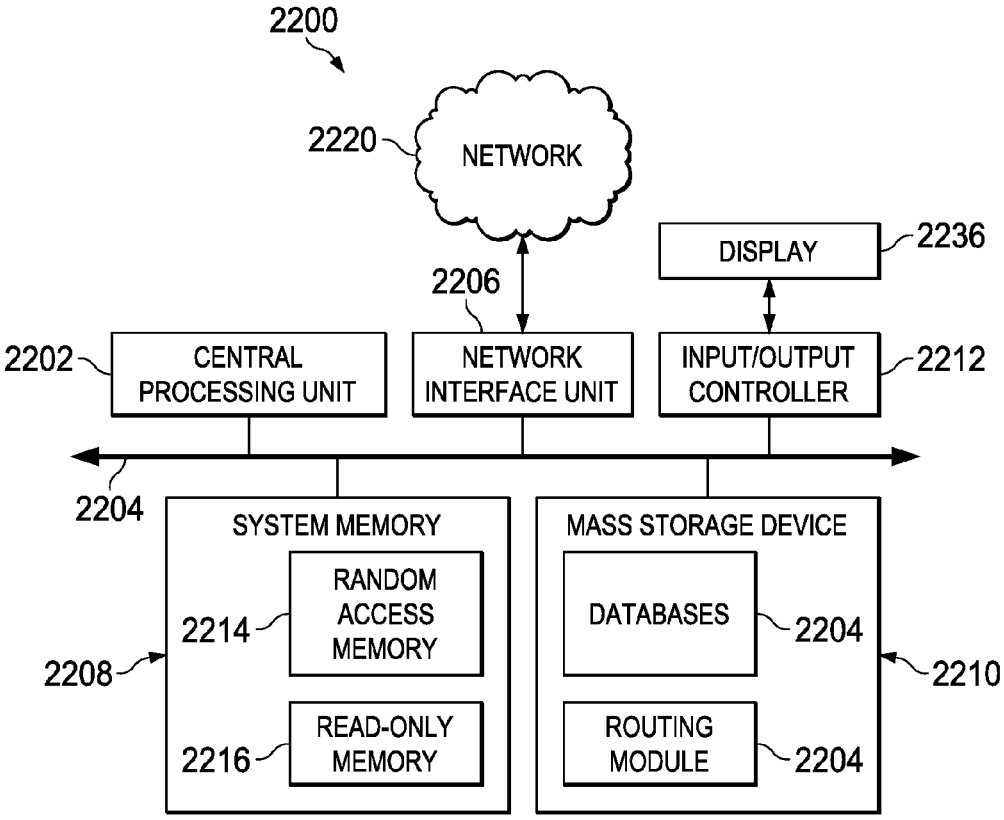
FIG. 22 is an illustration of a computer architecture of a routing tool capable of executing the software components described herein for determining landing sites for aircraft in accordance with an illustrative embodiment.

FIG. 22 shows an illustrative computer architecture 2200 of a routing tool 1100 capable of executing the software components described herein for determining landing sites for aircraft, as presented herein. As explained above, the routing tool 1100 may be embodied in a single computing device or in a combination of one or more processing units, storage units, and/or other computing devices implemented in the avionics systems of the aircraft and/or a computing system of an ATC, AOC, or other off-board computing system. The computer architecture 2200 includes one or more central processing units 2202 ("CPUs"), a system memory 2208, including a random access memory 2214 ("RAM") and a read-only memory 2216 ("ROM"), and a system bus 2204 that couples the memory to the CPUs 2202.

The CPUs 2202 may be standard programmable processors that perform arithmetic and logical operations necessary for the operation of the computer architecture 2200. The CPUs 2202 may perform the necessary operations by transitioning from one discrete, physical state to the next through the manipulation of switching elements that differentiate between and change these states. Switching elements may generally include electronic circuits that maintain one of two binary states, such as flip-flops, and electronic circuits that provide an output state based on the logical combination of the states of one or more other switching elements, such as logic gates. These basic switching elements may be combined to create more complex logic circuits, including registers, adders-subtractors, arithmetic logic units, floating-point units, and the like.

The computer architecture 2200 also includes a mass storage device 2210. The mass storage device 2210 may be connected to the CPUs 2202 through a mass storage controller (not shown) further connected to the bus 2204. The mass storage device 2210 and its associated computer-readable media provide non-volatile storage for the computer architecture 2200. The mass storage device 2210 may store various avionics systems and control systems, as well as specific application modules or other program modules, such as the routing module 1102 and the databases 1104 described above with reference to FIG. 11. The mass storage device 2210 also may store data collected or utilized by the various systems and modules.

The computer architecture 2200 may store programs and data on the mass storage device 2210 by transforming the physical state of the mass storage device to reflect the information being stored. The specific transformation of physical state may depend on various factors, in different implementations of this disclosure. Examples of such factors may include, but are not limited to, the technology used to implement the mass storage device 2210, whether the mass storage device is characterized as primary or secondary storage, and the like. For example, the computer architecture 2200 may store information to the mass storage device 2210 by issuing instructions through the storage controller to alter the magnetic characteristics of a particular location within a magnetic disk drive device, the reflective or refractive characteristics of a particular location in an optical storage device, or the electrical characteristics of a particular capacitor, transistor, or other discrete component in a solid-state storage device. Other transformations of physical media are possible without departing from the scope and spirit of the present description, with the foregoing examples provided only to facilitate this description. The computer architecture 2200 may further read information from the mass storage device 2210 by detecting the physical states or characteristics of one or more particular locations within the mass storage device.

Although the description of computer-readable media contained herein refers to a mass storage device, such as a hard disk or CD-ROM drive, it should be appreciated by those skilled in the art that computer-readable media can be any available computer storage media that can be accessed by the computer architecture 2200. By way of example, and not limitation, computer-readable media may include volatile and non-volatile, removable and non-removable media implemented in any method or technology for storage of information such as computer-readable instructions, data structures, program modules, or other data. For example, computer-readable media includes, but is not limited to, RAM, ROM, EPROM, EEPROM, flash memory or other solid state memory technology, CD-ROM, digital versatile disks ("DVD"), HD-DVD, BLU-RAY, or other optical storage, magnetic cassettes, magnetic tape, magnetic disk storage or other magnetic storage devices, or any other medium which can be used to store the desired information and which can be accessed by the computer architecture 2200.

According to various embodiments, the computer architecture 2200 may operate in a networked environment using logical connections to other avionics in the aircraft and/or to systems off-board the aircraft, which may be accessed through a network 2220. The computer architecture 2200 may connect to the network 2220 through a network interface unit 2206 connected to the bus 2204. It should be appreciated that the network interface unit 2206 may also be utilized to connect to other types of networks and remote computer systems. The computer architecture 2200 also may include an input-output controller 2222 for receiving input and providing output to aircraft terminals and displays, such as the in-flight display 1136 described above with reference to FIG. 11. The input-output controller 2222 may receive input from other devices as well, including a PFD, an EFB, a NAY, an HUD, MDU, a DSP, a keyboard, mouse, electronic stylus, or touch screen associated with the in-flight display 1136. Similarly, the input-output controller 2222 may provide output to other displays, a printer, or other type of output device.

Based on the foregoing, it should be appreciated that technologies for determining landing sites for aircraft are provided herein. Although the subject matter presented herein has been described in language specific to computer structural features, methodological acts, and computer-readable media, it is to be understood that the invention defined in the appended claims is not necessarily limited to the specific features, acts, or media described herein. Rather, the specific features, acts, and mediums are disclosed as example forms of implementing the claims.

The description of the different illustrative embodiments has been presented for purposes of illustration and description, and is not intended to be exhaustive or limited to the embodiments in the form disclosed. Many modifications and variations will be apparent to those of ordinary skill in the art.

Further, different illustrative embodiments may provide different features as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A method for managing a landing site for an aircraft, the method comprising:

selecting, using a navigation tool, the landing site from a group of landing sites;

determining, using a routing tool, a touchdown point on the landing site;

growing, using the routing tool, a spanning tree comprising a minimum cost path up from the touchdown point to an origin point in the air;

computing, using the routing tool, a route from a current location of the aircraft to the origin point, the route being four-dimensional;

communicating, to a platform, a description of a state of the aircraft along the route of the aircraft over time to the landing site; and flying the aircraft to the landing site using the description of the state of the aircraft along the route of the aircraft over time.

2. The method of claim 1 further comprising:

continuously updating a group of routes to the group of landing sites for the aircraft, wherein the route to the landing site is within the group of routes to the group of landing sites.

3. The method of claim 2, wherein the updating step comprises:

continuously updating the group of routes to the group of landing sites for the aircraft based on a range of the aircraft, wherein the route to the landing site is within the group of routes to the group of landing sites.

4. The method of claim 1, wherein the route takes into account a group of obstacles along the route from the current location of the aircraft to the landing site.

5. The method of claim 1, further comprising communicating comprising aircraft intent description language, wherein the aircraft is a first aircraft and wherein the selecting and communicating steps are performed in a location selected from one of; the first aircraft, a ground station, an air traffic control station, and a second aircraft.

6. The method of claim 1, wherein the description comprises instructions that describe an aerodynamic configuration of the aircraft and a motion of the aircraft.

7. The method of claim 6, wherein the instructions follow rules for describing the aerodynamic configuration of the aircraft and the motion of the aircraft, based upon a performance model, for the aircraft, continually generated from actual performance data of the aircraft.

8. The method of claim 1, wherein the aircraft is a first aircraft, the platform is a second aircraft, and the second aircraft is configured to use the description to perform collision avoidance.

9. The method of claim 1, wherein the aircraft is an unmanned aerial vehicle and the platform is a control station for the unmanned aerial vehicle.

10. The method of claim 1, wherein the platform is selected from one of an air traffic control tower, a ground station, and a second aircraft.

11. An apparatus comprising:

a navigation tool configured to select a landing site from a group of landing sites and communicate to a platform a description of a state of an aircraft along a route of the aircraft over time to the landing site; and a routing tool configured to:

determine a touchdown point on the landing site;

grow a spanning tree comprising a minimum cost path up from the touchdown point to an origin point in the air; and compute a four-dimensional route from a current location of the aircraft to the origin point.

12. The apparatus of claim 11 further comprising:

a controller configured to fly the aircraft to the landing site using the description of the state of the aircraft along the route of the aircraft over time.

13. The apparatus of claim 11, wherein the navigation tool is further configured to update a group of routes to the group of landing sites for the aircraft, wherein the route to the landing site is within the group of routes to the group of landing sites.

14. The apparatus of claim 13, wherein in being configured to update the group of routes to the group of landing sites for the aircraft, the navigation tool is configured to update the group of routes to the group of landing sites for the aircraft based on a range of the aircraft, wherein the route to the landing site is within the group of routes to the group of landing sites.

15. The apparatus of claim 11, wherein the route takes into account a group of obstacles from the current location of the aircraft to the landing site.

16. The apparatus of claim 11, wherein the navigation tool is located in at least one of the aircraft, a ground station, and another aircraft.

17. The apparatus of claim 11, wherein the description comprises instructions that describe an aerodynamic configuration of the aircraft and a motion of the aircraft.

18. The apparatus of claim 11, wherein the aircraft is a first aircraft, the platform is a second aircraft, and the second aircraft is configured to use the description to perform collision avoidance.

19. The apparatus of claim 11, wherein the aircraft is a first aircraft and wherein the platform is selected from one of an air traffic control tower, a ground station, and a second aircraft.

20. A method for selecting a landing site for an aircraft in flight, the method comprising;

monitoring a current state of the aircraft and an issue at a destination;

determining when at least one of: the current state of the aircraft, and the issue at the destination, make landing at the destination undesirable;

selecting, using a navigation tool, the landing site from a group of landing sites, based upon a group of factors comprising: terrain data, airspace data, weather data, vegetation data, transportation infrastructure data, populated areas data, obstructions data, and utilities data;

determining, using a routing tool, a touchdown point on the landing site;

growing, using the routing tool, a spanning tree comprising a minimum cost path up from the touchdown point to an origin point in the air, such that cost comprises a function of at least one of: time, energy, and fuel;

computing, using the routing tool, a four-dimensional route from a current location of the aircraft to the origin point, based upon the group of factors; and communicating to another aircraft and at least one of: an Air Traffic Control center, an Airborne Operations Center, and an Air Route Traffic Control Center, a description of a state of the aircraft along the route of the aircraft over time to the landing site.

* * * * *